US005602527A

United States Patent [19]

Suenaga

[11] Patent Number: 5,602,527

[45] Date of Patent: Feb. 11, 1997

[54] MAGNETIC MARKER FOR USE IN IDENTIFICATION SYSTEMS AND AN INDENTIFICATION SYSTEM USING SUCH MAGNETIC MARKER

[75] Inventor: Wataru Suenaga, Saitama, Japan

[73] Assignee: Dainippon Ink & Chemicals Incorporated, Tokyo, Japan

[21] Appl. No.: 393,319

[22] Filed: Feb. 23, 1995

[51] Int. Cl.[6] ..... G08B 13/24

[52] U.S. Cl. ..... 340/551; 148/103; 148/105; 340/572

[58] Field of Search ..... 340/551, 572; 148/103, 105

[56] References Cited

U.S. PATENT DOCUMENTS

| | | | |
|---|---|---|---|
| 4,510,490 | 4/1985 | Anderson, III et al. | 340/551 |
| 4,935,724 | 6/1990 | Smith | 340/551 |
| 5,029,291 | 7/1991 | Zhou et al. | 340/551 |
| 5,401,584 | 3/1995 | Minasy et al. | 340/572 |
| 5,469,140 | 11/1995 | Liu et al. | 340/551 |
| 5,499,015 | 3/1996 | Winkler et al. | 340/551 |

FOREIGN PATENT DOCUMENTS

| | | |
|---|---|---|
| 58-192197 | 11/1983 | Japan . |
| 58-219677 | 12/1983 | Japan . |
| 62-67485 | 3/1987 | Japan . |
| 62-67486 | 3/1987 | Japan . |
| 62-69183 | 3/1987 | Japan . |
| 62-69184 | 3/1987 | Japan . |
| 62-90039 | 4/1987 | Japan . |
| 6-309573 | 11/1994 | Japan . |
| 92/12402 | 7/1992 | WIPO . |

*Primary Examiner*—Glen Swann
*Attorney, Agent, or Firm*—Armstrong, Westerman, Hattori, McLeland & Naughton

[57] ABSTRACT

An assembly of a dry coating (A) that has a magnetic powder with a saturation flux density of at least 100 emu/g is dispersed in a binder. A magnetostrictive metal (B), when the coating (A) is magnetized, resonates mechanically at a predetermined frequency in the range of varying frequencies. The varying frequencies are generated from an applied alternating magnetic field. Changes in flux density and permeability are experienced. When the coating (A) is not magnetized, metal (B) does not resonate at the predetermined frequency, thus experiencing no changes in flux density or permeability. The dry coating (A) and the metal (B) have a superposed relationship in such a way that the latter is capable of mechanical resonance, the marker being so adapted that when said coating (A) is magnetized, the predetermined frequency at which the flux density or permeability will change is generated as a signal in response to the applied alternating magnetic field.

20 Claims, 21 Drawing Sheets

DEMAGNETIZED

MAGNETIZED

COMPARATIVE EXAMPLE 2 (SIXTH-HARMONIC)

COMPARATIVE EXAMPLE 3 (SIXTH-HARMONIC)

EXAMPLE 2 (20th-HARMONIC)

COMPARATIVE EXAMPLE 2 (20th-HARMONIC)

EXAMPLE 4

EXAMPLE 2 (SIXTH-HARMONIC)

EXAMPLE 2 (12th-HARMONIC)

EXAMPLE 4 (12th-HARMONIC)

EXAMPLE 4 (20th-HARMONIC)

MAGNETIC MARKER FOR USE IN IDENTIFICATION SYSTEMS AND AN INDENTIFICATION SYSTEM USING SUCH MAGNETIC MARKER

BACKGROUND OF THE INVENTION

This invention relates to a magnetic marker for use in identification systems and particularly concerns a magnetic marker for reading identification information such as checkup data. The magnetic marker of the invention is applicable to electronic article surveillance systems, for prevention of forgery, as well as to data carriers and magnetic cards.

Article identify systems that use magnetic markers are known and a representative type is described in WO92/12402 with the title of invention of "Remotely Readable Data Storage Devices and Apparatus". This article identify system comprises a detection area for identification, an external alternating magnetic field producing means that is provided within the area and which performs sweeping through a range of frequencies to generate varying frequencies, a magnetic marker for use in identification systems as attached to an article that need be identified and that is predestined to pass through the area, the marker comprising an assembly of a magnetic layer that has been magnetized to have a magnetic pattern according to a bias magnetic field and a magnetostrictive metal (B) that will resonate mechanically at predetermined frequencies within the range of frequencies that are generated from the means within the area in such a way as to experience changes in magnetic flux density and permeability, the magnetic layer and the metal (B) being layered so that the latter is capable of mechanical resonance, the magnetic marker being so adapted that the predetermined frequencies at which the magnetic flux density or permeability changes is generated as an identification signal within the area according to the magnetic pattern provided in the magnetic layer by magnetization, and means for detecting the resonance of the marker at the predetermined frequencies which is generated from the means within the area. Thus, the identification system under consideration responds to the presence of the marker within the area.

According to page 11 of the specification of WO92/12402, an exemplary material that can be used is a plate that consists of a non-magnetic substrate having a magnetic coating thereon, such as slurry-formed ferrite as in magnetic tapes.

The conventional markers described above use the particles of magnetic materials such as ferrite and $\gamma$-$Fe_2O_3$, but the use of such magnetic powders suffers from a common defect in that the magnetic coating which constitutes the marker is fairly thick. The thick magnetic coating causes additional problems such as difficulty in manufacturing flexible markers and the increase in the number of production steps, which will lead to a lower productivity, occasionally to complete failure in manufacture.

SUMMARY OF THE INVENTION

An object, therefore, of the invention is to provide a magnetic marker that is free from the aforementioned problems with the prior art, i.e., "the magnetic coating is so thick as to deteriorate the flexibility of markers and the efficiency of their production".

With a view to attaining this object, the present inventor conducted intensive studies on the magnetic marker for use in identification systems with respect to the assemblies of a magnetostrictive metal that would respond to an alternating magnetic field and a hard magnetic material that would impart a bias magnetic field, particularly concerning major factors that would influence the characteristics of the bias field producing hard magnetic material. As a result, the inventor found that the stated object could be attained when a magnetic powder having a significantly higher saturation flux density than in the prior art was used as the hard magnetic material and by using a dry coating that had such magnetic powder dispersed in a binder. The present invention had been accomplished on the basis of this finding.

Thus, the present invention provides a magnetic marker for use with an object identification system that comprises an assembly of a dry coating (A) that has a magnetic powder with a saturation flux density of at least 100 emu/g (electromagnetic units per gram $-1$ emu/g=$1.257\times10^{-4}$ W6/kg) dispersed in a binder and a magnetostrictive metal (B) which, when the coating (A) is magnetized, resonates mechanically at predetermined frequencies in the range of varying frequencies generated from an applied alternating magnetic field, thereby experiencing changes in flux density and permeability and which, when the coating (A) is not magnetized, does not resonate at the predetermined frequencies, thus experiencing no changes in flux density or permeability, the dry coating (A) and the metal (B) being in a superposed relationship in such a way that the latter is capable of mechanical resonance, the marker being so adapted that when the costing (A) is magnetized, the predetermined frequencies at which the flux density or permeability will change is generated as a signal in response to the applied alternating magnetic field.

DETAILED DESCRIPTION OF THE INVENTION

Figure 1:
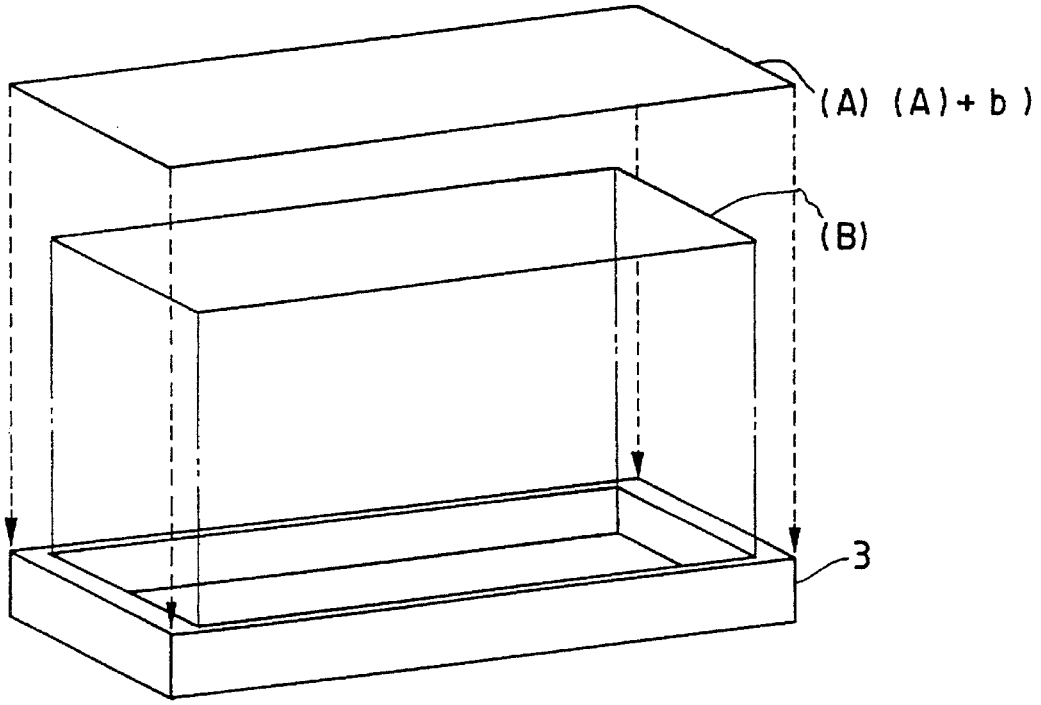
FIG. 1 is a diagram showing schematically the basic configuration of a magnetic marker that resonates mechanically at a predetermined frequency in response to an applied alternating magnetic field of varying frequencies within a detection area.
Figure 2:
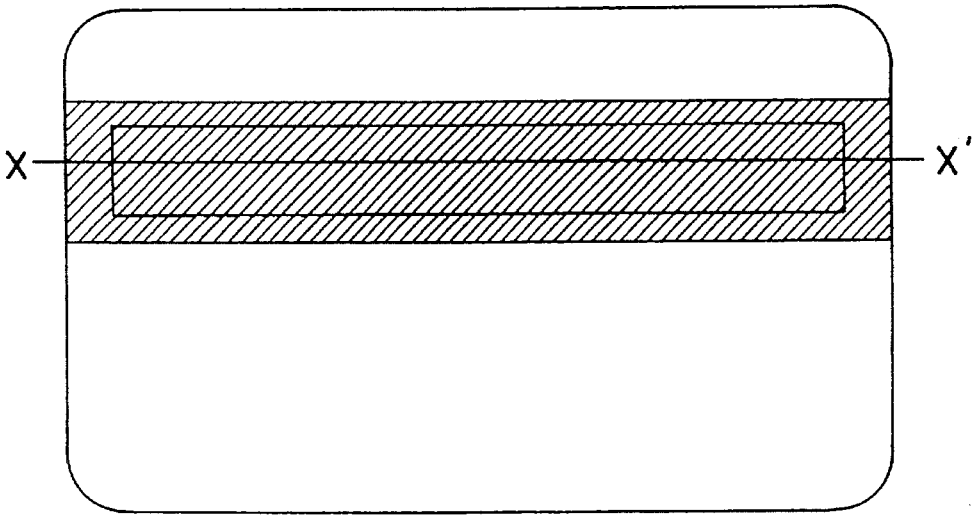
FIG. 2 is a schematic plan view showing an example of the marker of the invention in a card form.

The magnetic marker of the invention will now be described in detail. The marker comprises an assembly of a dry coating (A) that has a magnetic powder with a saturation flux density of at least 100 emu/g dispersed in a binder and a magnetostrictive metal (B) which, when the coating (A) is magnetized, resonates mechanically at a predetermined frequency in the range of varying frequencies generated from an applied alternating magnetic field, thereby experiencing changes in flux density and permeability and which, when the coating (A) is not magnetized, does not resonate at the predetermined frequency, thus experiencing no changes in flux density or permeability, the dry coating (A) and the metal (B) being in a superposed relationship in such a way that the latter is capable of mechanical resonance.

The marker is structurally so characterized that when the coating (A) is magnetized to have a magnetic pattern according to a bias field, the marker responds to a varying applied alternating magnetic field (which is so adapted that the field forming frequency changes from the lower to higher value or vice versa) by generating as an identification signal at least one predetermined frequency at which the flux density or permeability changes. It should be noted here that when the coating (A) is not magnetized, the marker of the invention will not generate any output signal associated with the predetermined frequency (i.e., at which the flux change or permeability changes) in response to the varying applied alternating magnetic field.

The magnetic marker of the invention generates signals when the magnetic coating (A) is magnetized. It employs an external alternating magnetic field that performs sweeping through a range of frequencies to produce varying frequencies.

The magnetic marker comprises an assembly of the coating (A) and the metal (B) that are in a superposed relationship in such a way that the latter is capable of mechanical resonance. It should be remembered that the marker will not function if the coating (A) is bonded to the metal (B). An example of the assembly is such that it has the coating (A) and contains the metal (B) in an unfixed manner.

The shape of the metal (B) is not limited in any particular way. If it is necessary to identify more than one piece of information, a number of metals (B) of different shapes may be used in accordance with the number of pieces of information to be identified. However, it is preferred to use only one metal (B) and allow it to resonate with two or more harmonics of its natural or fundamental frequency according to the bias field produced from the coating (A) that has been magnetized to have a magnetic pattern in such a way that those harmonics are associated with the magnetic pattern.

When given a bias field from a single coating (A), the metal (B) will resonate at frequencies depending on a natural frequency characteristic of the shape or size of its own. The natural frequency of a single metal (B) is at least one characteristic and predetermined frequency.

The marker of the invention may specifically be a hexahedron that has the coating (A) provided on one face and which contains a strip of the metal (B) in cavity in the hexahedron in such a way that it is capable of resonance. If possible, the direction in which the magnetic particles are dispersed in the binder in the dry coating (A) may be aligned with the direction in which the metal (B) resonates mechanically and this is preferred since the chance of nonlinear vibrations to occur in association with the shape of the metal (B) at frequencies other than the intended resonant frequency which is to be used for identification purposes is small and because effective detection is assured without the possibility of the generation of an undesired resonant frequency.

It should also be noted that the marker of the invention may be of any shape such as a strip or a card.

An example of the magnetic marker of the invention will now be described with particular reference to FIG. 3. As shown schematically in section, the magnetic marker of the invention may comprise a non-magnetic base b that carries a magnetic layer formed of the dry coating (A) and which has a non-magnetic casing 3 on the side remote from the magnetic layer in such a way that it contains the metal (B) in such a way that the latter is capable of mechanical resonance. Although not shown, the coupling between the non-magnetic base b and the non-magnetic casing 3 in which the metal (B) is contained in an unfixed manner may be effected either by adopting a composite shape that is capable of combining the geometries of the mating portions integrally or by using a pressure-sensitive adhesive.

When the coating (A) is magnetized, the point of its magnetization, namely, the strength of magnetic field that is generated from the point of polarity, is determined by the distance between this point of polarity and the point of measurement and decreases with the increasing distance. Considering the thickness of the metal (B), it is desired to apply a bias field uniformly from the coating (A) to the metal (B).

Since the field strength drops significantly near the surface of the coating (A) and because the metal (B) has a certain thickness, the two members are preferably placed in a superposed relationship, with an optimal space being provided, rather than being brought into direct contact with each other. The space between the two members may be adjusted by changing a certain parameter, say, the thickness of the non-magnetic base b. If desired, the non-magnetic base b may serve not only as a support of the coating (A) but also as a protector of the metal (B). Considering this possibility, the non-magnetic base b has preferably a thickness of 10 to 250 μm, more preferably 25 to 100 μm. The thickness of the coating (A) is determined by determining the thickness of the non-magnetic base b and a preferred bias field strength.

The non-magnetic casing 3 which is customarily used as part of the magnetic marker of the invention may be formed of any one of the known conventional synthetic resins such as polystyrene, poly(methyl methacrylate), ABS, vinyl chloride, polyethylene, polypropylene, polycarbonate, PET, PBT and PPS. The non-magnetic base b may be coupled to the non-magnetic casing 3 by means of adhesives such as vinyl chloride-vinyl acetate copolymer, ethylene-vinyl acetate copolymer, vinyl chloride-propionic acid copolymer, rubber base resins, cyanoacrylate resins, cellulosic resins, ionomer resins, polyolefinic resin and polyurethane resins. The adhesive layer is typically formed in a thickness of 5 to 10 μm. Tackifiers may also be used to couple the two members and they include vinyl chloride resins, vinyl acetate resins, vinyl chloride-vinyl acetate copolymer, ethylene-vinyl acetate copolymer, vinyl chloride-propionic acid copolymer, rubber base resins, acrylic copolymer resins, cyanoacrylate resins, cellulosic resins, ionomer resins, polyolefinic resins, polyurethane resins, polyester resins, polyamide resins, acrylonitrile butadiene resins, natural rubbers and rosins. The tackifier layer is typically formed in a thickness of 20 to 30 μm.

The marker of the invention may advantageously be fabricated by the following method. First, a non-magnetic base indicated by 4' in FIG. 4 that has a cutout made to provide a space that is large enough to accommodate a strip of metal (B) in an unfixed manner so that it is capable of mechanical resonance and a non-magnetic base 4 that has no such cutout are bonded to provide a non-magnetic casing C having a groove. Alternatively, a groove is cut in a non-magnetic base that is relatively thick enough to provide the space mentioned above.

The strip is accommodated in the thus formed groove in the casing C and the edge portion 4' around the groove is bonded to the side of the non-magnetic base b that is remote from the side where the magnetic layer of the coating (A) is formed. Thus, one obtains the marker of the invention which has the strip of metal (B) accommodated in the groove.

A pressure-sensitive adhesive may be used to bond the non-magnetic bases 4 and 4' together, as well as to bond the non-magnetic casing C to the side of the non-magnetic base b that is remote from the side where the coating (A) is formed. Exemplary adhesives that are applicable include vinyl chloride-vinyl acetate copolymer, ethylene-vinyl acetate copolymer, vinyl chloride-propionic acid copolymer, rubber-base resins, cyanoacrylate resins, cellulosic resins, ionomer resins, polyolefinic resins and polyurethane resins. The adhesive layer is typically formed in a thickness of 0.1 to 10 μm.

The non-magnetic bases 4 and 4' may be bonded together by compressing them under heating. To effect this, a pair of metal or rubber rolls may be provided in a face-to-face relationship so that one of them is heated and brought into contact with one base, say 4, whereas the other base, say 4', is bonded to the first base under the action of the nip pressure and the heat of the rolls. Alternatively, a hot press may be used to achieve the same result. The conditions of heating and pressurization vary with the material of the bases used; typically, the temperature is adjusted to lie between 100° and 300° C. and the pressure is selected at about 10 kg/cm$^2$ irrespective of whether heated rolls or a hot press is used. The bonding speed is suitably at about 50 m/min.

Needless to say, the same method may be adopted in bonding the non-magnetic casing C (which accommodates the strip of metal (B)) to the side of the non-magnetic base b that is remote from the side where the coating (A) is formed.

The depth of the groove in the casing C is not limited to any particular value and the only condition that need be satisfied is that it provides a space that is large enough to permit mechanical resonance of the strip B. If the marker of the invention is to be assembled in a credit card with a magnetic strip that satisfies the specifications under the JIS (Japanese Industrial Standard) (i.e., thickness, 0.68 to 0.80 mm; length, 85.7 mm; width, 54.03 mm), the condition under consideration can be met by using a substrate in the form of a polyester film 250 μm thick.

The non-magnetic bases indicated by 4, 4' and b may be formed of any one of the following materials: plastic films or sheets of polyethylene, polypropylene, poly-vinyl chloride, poly-vinylidene chloride, poly-ethylene naphthalate, poly-vinyl alcohol, poly-ethylene terephthalate, polycarbonates, nylons, polystyrene, ethylene-vinyl acetate copolymer, ethylene-vinyl copolymer, cellulose diacetate and polyimide; non-magnetic metals such as aluminum; paper and impregnated paper; and composites of these materials. Other materials can be used without any particular limitations if they possess the necessary characteristics in such aspects as strength, constitution, hiding property and light-transmitting quality. The non-magnetic bases 4 and 4' are preferably light-opaque in order to mask the strip of metal (B) in the marker.

The magnetic layer made of the coating (A) is desirably adapted in such a way that the field strength at a distance equal to the thickness of the non-magnetic base b is optimumly set to mechanically resonate the marker.

Using a magnetic powder having a saturation flux density of at least 100 emu/g is preferred since the thickness of the dry coating (A) can be reduced and because highly flexible markers can be produced with higher efficiency.

The magnetic powder meeting this requirement may be a compound ferromagnetic powder or a ferromagnetic metal powder. Examples of the first type include iron carbide and iron nitride. Examples of the second type are alloys that have a metal content of at least 75 wt %, with at least 80 wt % of the metal content being assumed by at least one ferromagnetic metal (e.g., Fe, Co or Ni) or at least one alloy (e.g., Fe—Co, Fe—Ni, Co—Ni or Co—Ni—Fe), and that contain a third component (e.g., Al, Si, Pb, Se, Ti, V, Cr, Mn, Cu, B, Y, Mo, Rh, Rd, Ag, Sn, Sb, P, Ba, Ta, W, Re, Au, Hg, S, Bi, La, Ce, Pr, Nd, Zn or Te) in an amount not exceeding 20 wt % of the metal content. These ferromagnetic metal powders may contain small amounts of water, hydroxides or oxides. These ferromagnetic powders can be prepared by known methods and those which are prepared by any known techniques can be used in the present invention.

Examples of the binder that may be used to form the coating (A) include vinyl chloride containing copolymers such as a vinyl chloride-vinyl acetate copolymer, a terpolymer of vinyl chloride, vinyl acetate and vinyl alcohol, maleic anhydride or acrylic acid, a vinyl chloride-vinylidene acetate copolymer, a vinyl chloride-acrylonitrile copolymer, and a copolymer containing vinyl chloride and a polar group such as a sulfonyl group or an amino group; cellulosic derivatives such as nitrocellulose; polyvinyl acetal resins; acrylic resins; polyvinyl butyral resins; epoxy resins; phenoxy resins; polyurethane resins; polyester polyurethane resins; polyurethane resins having a polar group such as a sulfonyl group; and polycarbonate polyurethane base resins.

These resins may be used either independently or two or more resins may be used in admixtures, as exemplified by the combination of a vinyl chloride containing resin and a polyurethane base resin and the combination of a cellulosic resin and a polyurethane base resin.

The binder formed of these resins may preferably be used in an amount ranging from 15 to 40 parts by weight per 100 parts by weight of the magnetic powder.

Examples of the dispersant that may be used to form the coating (A) include lecithin, higher alcohols and surfactants. These dispersants are preferably used in amounts ranging from 0.5 to 3.0 parts by weight per 100 parts by weight of the magnetic powder.

The magnetic powder, binder and the dispersant described above are processed with a variety of kneaders or dispersers to prepare magnetic paints. To this end, a roll-type kneader such as a twin roll mill or a triple-roll mill or a disperser such as a ball-type rotary mill is charged with the respective components either simultaneously or successively.

The thus prepared magnetic paint is applied on to a non-magnetic base and the magnetic particles in the applied layer are oriented unidirectionally by means of a permanent or solenoid magnet having a field strength of, say, 1,000 to 10,000 gauss, followed by drying to form a magnetic layer made of the dry coating (A).

The magnetic orientation helps improve squareness ratio to increase the residual flux density of the coating (A). The squareness ratio is defined as the magnetic induction at zero magnetizing force divided by the maximum magnetic induction, in a symmetric cyclic magnetization of a material, or the magnetic induction when the magnetizing force has changed half-way from zero toward its negative limiting value divided by the maximum magnetic induction in a symmetric cyclic magnetization of a material. In a hysteresis curve showing change of magnetic flux density when a magnetic substance is entered into a magnetic field H, if Bm denotes a maximum magnetic flux density at maximum magnetic field and Br denotes a residual flux density at a magnetic field 0, Br/Bm is defined as a squareness ratio. The residual flux density and the thickness of the coating (A) combine to determine the magnitude of the bias field that is produced by the magnetic coating (A) when it is magnetized to have a magnetic pattern. Hence, an improved squareness ratio means that the thickness of the coating (A) can be significantly reduced for a given strength of bias field to be obtained.

As a further advantage, the density of magnetization to give a magnetic pattern and the number of elements (i.e., resolution) are markedly improved and a bias field of the necessary magnitude can be produced in a consistent manner upon magnetization to give a magnetic pattern that generates overtone frequencies which are the frequencies of higher harmonics. Thus, the dynamic range of resonant frequencies that serve as identification signals is expanded.

If desired, the magnetic layer of the coating (A) may be calendered in order to produce a greater bias field upon magnetization of the coating (A). Calendaring is defined as passing a material through rollers or plates to thin it into sheets or make it smooth and glossy.

The magnetic paint may be applied by a variety of methods including air doctor coating, blade coating, rod coating, extrusion coating, air-knife coating, squeeze coating, dip coating, reverse roll coating, transfer roll coating, gravure coating, kiss coating, cast coating, spray coating, etc.

The coating (A) has preferably a thickness in the range 5 to 100 μm and its residual flux (per unit width) is preferably in the range 1 to 25 Mx/cm (Maxwells per centimeter).

When applying the magnetic paint onto the non-magnetic base, the thickness of the magnetic layer may be increased at the sacrifice of the flexibility and productivity of magnetic markers. To this end, a coating (A) is formed on the non-magnetic base b in the usual manner and then overlaid with an adhesive layer 5 (see, FIG. 5). In a separate step, a coating (A)' is formed on a non-magnetic base b'. The base b' is superposed on the base 6, and the two magnetic layers are combined to form a single magnetic layer of an increased thickness.

Figure 4:
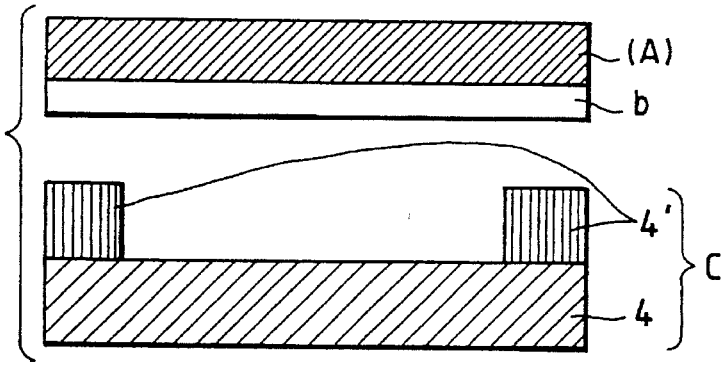
FIG. 4 is a diagram showing how to construct a nonmagnetic casing that contains a strip of metal (B) in an unfixed manner to permit its mechanical resonance.

The adhesive to be used in the adhesive layer and the conditions to form the latter may be the same as those which are employed in fabricating the magnetic marker of the invention by bonding the base b with the coating (A) to the non-magnetic casing formed of the bases 4 and 4' (see FIG. 4).

The thickness of the magnetic layer formed on the non-magnetic base b is related to the thickness of the latter. To exemplify this relevancy, the preferred ranges of the thickness of a magnetic layer (which is made of the dry coating (A) comparable to a commonly used ribbon of hard magnetic material with a thickness of 40 to 60 μm) and its residual flux (per unit width) are shown in Table 1 below for four different thicknesses of the non-magnetic base as measured from the side where no magnetic layer is formed.

TABLE 1

| Thickness of non-magnetic base (μm) | Thickness of coating (A) (μm) | Residual flux (per unit width) (Mx/cm) |
|---|---|---|
| 25 | 10–20 | 2.0–4.5 |
| 50 | 20–30 | 4.5–6.5 |
| 75 | 30–50 | 6.5–10.5 |
| 100 | 50–75 | 10.5–16.0 |

A protective layer may be provided on the coating (A) and exemplary resins that may be used to form the protective layer include: cellulose derivatives such as ethyl cellulose and acetyl cellulose; styrene resins such as polystyrene or styrenic copolymer resins; homo- or copolymers of acrylic or methacrylic acid such as poly(methyl methacrylate), poly(ethyl methacrylate), poly(ethyl acrylate) and poly(butyl acrylate); as well as poly(vinyl acetate), vinyl toluene resin, vinyl chloride resin, polyester resins, polyurethane resins and butyral resins.

These resins may be replaced by media that have additives of high hardness such as $\alpha$-$Al_2O_3$ or fine resin beads of polytetrafluoroethylene (PTFE) or the like dispersed therein in order to provide better resistance to wear.

The protective layer may be formed by any known coating techniques such as air doctor coating, blade coating, rod coating, extrusion coating, air-knife coating, squeeze coating, dip coating, reverse roll coating, transfer roll coating, gravure coating, kiss coating, cast coating and spray coating.

The marker of the invention may be so adapted that a tacky layer provided on it is covered with release paper. To use it, the marker is stripped of the release paper and attached to the object or article that need be identified.

The tacky layer may be formed of any suitable material that is selected from among vinyl chloride resin, vinyl acetate resin, vinyl chloride-vinyl acetate copolymer, ethylene-vinyl acetate copolymer, vinyl chloride-propionic acid copolymer, rubber base resins, acrylic copolymer resins, cyanoacrylate resins, cellulosic resins, ionomer resins, polyolefinic resins, polyurethane resins, polyester resins, polyamide resins, acrylonitrile butadiene resin, natural rubbers, rosin, etc. If the tacky layer is to be formed, its thickness ranges typically from 20 to 30 μm.

The protective layer may in turn be overlaid with a print layer that indicates necessary information such as the type of an output signal to be produced from the metal (B) or the type of the article that need be identified by the marker of the invention.

The metal (B) to be used in producing the marker of the invention is a magnetostrictive metal which, when the coating (A) is magnetized, resonates mechanically at a predetermined frequency within the range of varying frequencies generated from an applied alternating magnetic field, thereby experiencing changes in flux density and permeability and which, when the coating (A) is not magnetized, does not resonate at the predetermined frequency, thus experiencing no changes in flux density or permeability.

Magnetostriction means that property of a magnetic material which causes it to expand or shrink by a greater or smaller extent depending upon the strength of the applied magnetic field. When the coating (A) or the magnetic layer is magnetized, the magnetostrictive metal (B) is frozen in either an expanded or shrunk state depending upon the resulting bias field so that it is longer or shorter than when the coating (A) is not magnetized.

When the metal (B) is frozen in one of these states, it will resonate mechanically at the certain predetermined frequency within the range of varying frequencies generated from the applied alternating magnetic field, thereby experiencing abrupt changes in flux density and permeability. If the magnetic layer is not magnetized, the metal (B) will not resonate at the same frequency as that where it resonates in response to the magnetization of the magnetic layer.

According to the invention, the coating (A) in the marker is magnetized to have a magnetic pattern according to a bias field and this enables the marker to identify a certain object by an article identify system. The marker for practical use with an object identification system comprises an assembly of a dry coating (A) that has been magnetized to have a magnetic pattern according to a bias field and that has a magnetic power with a saturation flux density of at least 100 emu/g dispersed in a binder and a magnetostrictive metal (B) which will resonate mechanically at a predetermined frequency in the range of varying frequencies generated from an applied alternating magnetic field, thereby experiencing changes in flux density and permeability, the dry coating (A) and the metal (B) being in a superposed relationship in such a way that the latter is capable of mechanical resonance, the marker being so adapted that the predetermined frequency at which the flux density or permeability will change is generated as an identification signal in response to the applied alternating magnetic field according to the magnetic pattern produced in the magnetized coating (A).

It should be noted here that even if a single type of metal (B) is used, its resonant frequency can be altered by changing the biasing magnetization pattern in the coating (A). The marker present in an applied alternating magnetic field that generates varying frequencies needs only to detect abrupt changes that occur in flux density or permeability when it is placed in that field.

The predetermined frequency at which the metal (B) resonates mechanically to experience abrupt changes in flux density and permeability is peculiar to the length of that metal and defined by the following equation:

$$fn = n/2l \cdot \sqrt{(D/\rho)}$$

wherein n is an integer, l is the length of the metal (B), D is the Young's modulus of the metal (B), and ρ is the density of the metal (B). The fundamental frequency (f1) can be determined by substituting n=1 and the associated values of the other parameters into the equation.

The mechanism showing the presence of the marker under consideration which uses the metal (B) on the side remote from the side of the non-magnetic base which carries the magnetic layer is discussed in detail in Unexamined Published Japanese Patent Application (kokai) Sho 58-192197, which is incorporated herein as reference.

The metal (B) which is furnished with a bias field and which responds to an alternating magnetic field of a predetermined frequency within the range of externally applied varying frequencies may be selected from among any metallic materials that are both ferromagnetic and magnetostrictive and metals having values of magnetostriction in the range from 15 to 50 PPM (parts per million) are preferred. The metals that satisfy this requirement are exemplified by amorphous metals such as "METGLAS 2605SC", "METGLAS 2605CO" and "METGLAS 2826MB".

It should be particularly noted here that depending on the magnetic pattern provided in the coating (A) by magnetization, the value of n as the order of harmonics increases so much that the resonant frequency may sometimes unavoidably exceed 1 MHz. The metal (B) has a coercive force of no more than 0.5 Oe; however, because of its high residual flux density, the hysteresis loss which is a magnetic loss occurring at high frequencies is by no means negligible. Further, amorphous magnetostrictive metals have electric resistivity as small as 120 to 140 μΩ-m and the eddy-current loss they may experience is also by no means negligible. Under these circumstances, the metal (B) should desirably undergo the smallest possible hysteresis loss at the resonant frequency and it is particularly preferred that given an alternating magnetic field with a frequency of 1 KMz and a maximum field strength of 5 Oe, the hysteresis loss is within the range from 1 to 50 $J/m^3$.

Similarly, it is particularly preferred to use metal (B) that has a squareness ratio of no more than 0.3 given an alternating magnetic field with a frequency of 1 KMz and a maximum field strength of 5 Oe.

If one uses metal (B) that has a hysteresis loss or squareness ratio in the ranges set forth above within an alternating magnetic field having the above-specified frequency and field strength, the energy used for detection purposes is converted efficiently, enabling higher harmonics to be produced with greater output power. This tendency is especially pronounced when the harmonics are produced at high frequencies.

The shape of the metal (B) is not limited in any particular way and it may be a strip, a sheet, a wire or in any other form. In case of sheet shape, it is selectable from a rhombus, a trapezoid, a square, and a rectangular. In order to reduce the effects of antimagnetism and nonlinear vibrations that may occur on account of its geometry, the metal is preferably in a rectangular form, with the aspect ration (length-to-width ratio) being preferably at least 20 in order to insure that vibrations occur only along the longer side.

Figure 5:
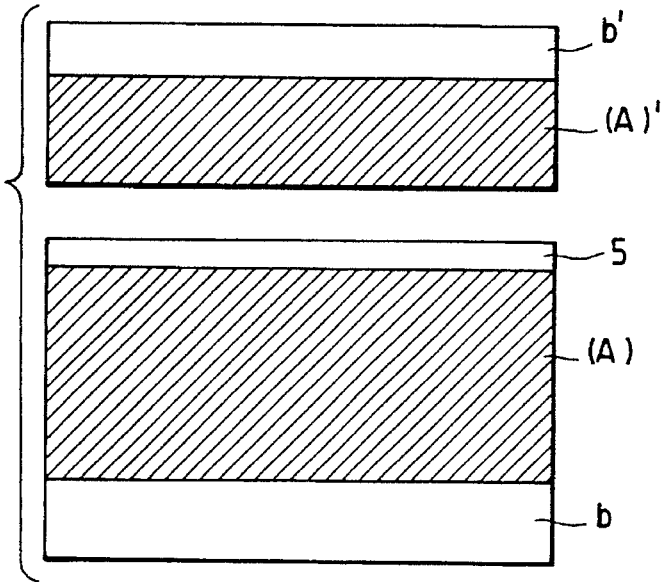
FIG. 5 is a schematic cross section showing the case of using a magnetic layer of increased thickness in the marker of the invention in a card form.

It should be added that the capacity for identification is significantly increased by combining longer sides of different lengths. The metal shown in FIGS. 3 to 5 is in a strip form and its width is preferably in the range from 15 to 35 μm.

As will be understood from the foregoing explanation, the actual use of the marker of the invention starts with applying a bias field from the coating (A) to the metal (B). To this end, the dry coating (A) is magnetized to have a magnetic pattern according to the bias field.

If the metal (B) is in a rectangular form, the direction parallel to its longer sides is the direction in which it vibrates in a mechanical resonance mode. The bias field which causes characteristic mechanical vibrations to occur along the longer sides of the metal (B) upon application of an alternating magnetic field is applied along the longer sides since the intended mechanical resonant vibrations are produced by deforming the metal (B) in the direction along its longer sides according to the waveform of vibrations.

Therefore, it is particularly preferred to magnetize the coating (A) to give a magnetic pattern in the direction parallel to the longer sides of the metal (B). It should further be mentioned that the length of the magnetic pattern complies with the length of the metal (B) and that, therefore, the metal will generate a resonant frequency dependent on its length in response to the bias field which is produced from the characteristic magnetic pattern.

Hence, even if the magnetized coating (A) forms an integral assembly with the metal (B), signals with at least two predetermined frequencies can be generated by magnetizing the coating (A) to give magnetic patterns according to a bias field that causes at least mechanical vibrations to occur in the metal (B).

The predetermined frequency that is generated from the metal (B) according to the bias field is such that two or more combinations of predetermined frequency can be produced as signals by selecting magnetic patterns from the range of frequencies that consists of the fundamental frequency for the resonant frequency and its multiples that are obtained from the range of frequencies through which the applied alternating magnetic field is swept. Consequently, this offers the advantage of increasing the capacity of the magnetic marker for identifying various objects.

The magnetomechanical coupling coefficient of the metal (B) varies with the magnitude of the bias field and peaks at the point where the rate of change in magnetostriction is the greatest. Stated more specifically, the magnetomechanical coupling coefficient increases with the increasing bias field, peaks at a certain strength of the bias field and then decreases.

The magnetomechanical coupling coefficient K is defined by the following equation (1); it is a function of effective permeability and measured by a mutual inductance method which is capable of measuring the effective permeability. The greater the magnetomechanical coupling coefficient, the higher the efficiency of energy conversion which causes mechanical resonance at the frequency of the proper vibration of the metal (B) upon application of an alternating magnetic field that has varying frequencies.

$$K=\sqrt{E_1/E_2} \quad (1)$$

(where $E_1$ is a mechanically stored energy and $E_2$ is a magnetically applied energy).

Therefore, a bias field of an optimal magnitude is necessary in order to attain the greatest possible magnetomechanical coupling coefficient at the frequency of the proper vibration of the metal (B). It should also be mentioned that a bias field having an optimal magnetic pattern must be applied in order to achieve an efficient magnetic to mechanical energy conversion so that the metal (B) will vibrate at the desired frequency of the proper vibration.

Stated more specifically, the magnetic pattern produced in the coating (A) by magnetization consists of a plurality of magnetized elements such that the N (or S) pole of one of two adjacent elements is at least in a face-to-face relationship with the N (or S) pole of the other element and that both ends of the magnetic pattern coincide with both ends of the metal (B). Each "element" consists of a pair of N and S poles.

If the both ends of the magnetic pattern of the magnetized coating (A) do not coincide with both ends of the metal (B) in longitudinal direction, the magnetic pattern become different from the desired pattern when the resonance frequencies are applied. Therefore, in this case, the resonance frequencies are not coincidence with the frequencies used for identification purposes. Accordingly, the arrangement in that the both ends of the magnetic pattern of the magnetized coating (A) coincide with both ends of the metal (B) is great convenient since the marker is resonated only at the resonant frequency which is used for identification purposes.

The method of magnetizing the coating (A) so that a bias field having a magnetic pattern is produced from the coating (A) toward the metal (B) is not limited in any particular way and a suitable method can be selected from among known conventional techniques depending upon the intended use and the requisite capacity of identification.

Sinusoidal or amplitude-composed sinusoidal patterns that are to be used as magnetic patterns for producing a bias field are described in detail in the specification of WO92/12402, which is incorporated herein as reference.

When a static magnetic field is applied to the metal (B), it develops a strain according to the strength of the applied field and the strain will saturate if the field strength exceeds a certain point. The strength of bias field which is produced upon magnetization of the coating (A) to give a magnetic pattern must be made smaller than the field strength at which the stain saturates. Given a bias field strength within this range, the change in strain that occurs in response to the change in the strength of a certain magnitude of static magnetic field being applied to the metal (B) corresponds to the extent by which the metal (B) can mechanically deform in response to an alternating magnetic field being applied to the metal (B). The change in strain correlates to the magnetomechanical coupling coefficient, which is a function of the bias field strength and expressed by a curve having a maximum at a certain value of the bias field strength (see FIG. 14).

In the range of bias field strength where the magnetomechanical coupling coefficient increases to peak with the increasing bias field strength and where the coupling coefficient is proportional to the bias field strength, the latter is proportional to the change in strain.

Therefore, if the magnetic pattern produced by the bias field consists of a single sinusoidal wave, the change in strain complies with the sinusoidal wave and in the presence of an applied alternating magnetic field to the metal (B), the latter will resonate mechanically when the frequency of the sinusoidal wave coincides with that of the alternating field, whereupon the flux density or permeability of the metal (B) will increase. If the magnetic pattern for producing the bias field consists of a plurality of amplitude-composed sinusoidal waves as indicated by dotted lines in FIG. 31, the metal (B) will resonate at the original sinusoidal waves before composition, producing a plurality of resonant frequencies at which the flux density or permeability increases.

Alternatively, magnetization can be accomplished by a magnetic pattern consisting of a rectangular wave or a composite of rectangular waves having different frequencies.

If the coating (A) with necessary adjustments made in thickness and other parameters is magnetized with a rectangular wave and when the bias field strength at which a pulsed magnetic pattern is produced coincides with the field strength at which the magnetomechanical coupling efficiency peaks, the change in the strain of the metal (B) becomes maximal, producing a much greater signal output at the resonant frequency than when a magnetic pattern consisting of a sinusoidal wave is produced.

A rectangular wave pattern can be obtained in such a way that magnetization is saturated at intervals where the amplitude of a composition wave, that is composed sinusoidal waves having different frequencies, being zero. In case of the coating is magnetized by rectangular wave pattern, the pulse pattern can be written into.

Figure 31:
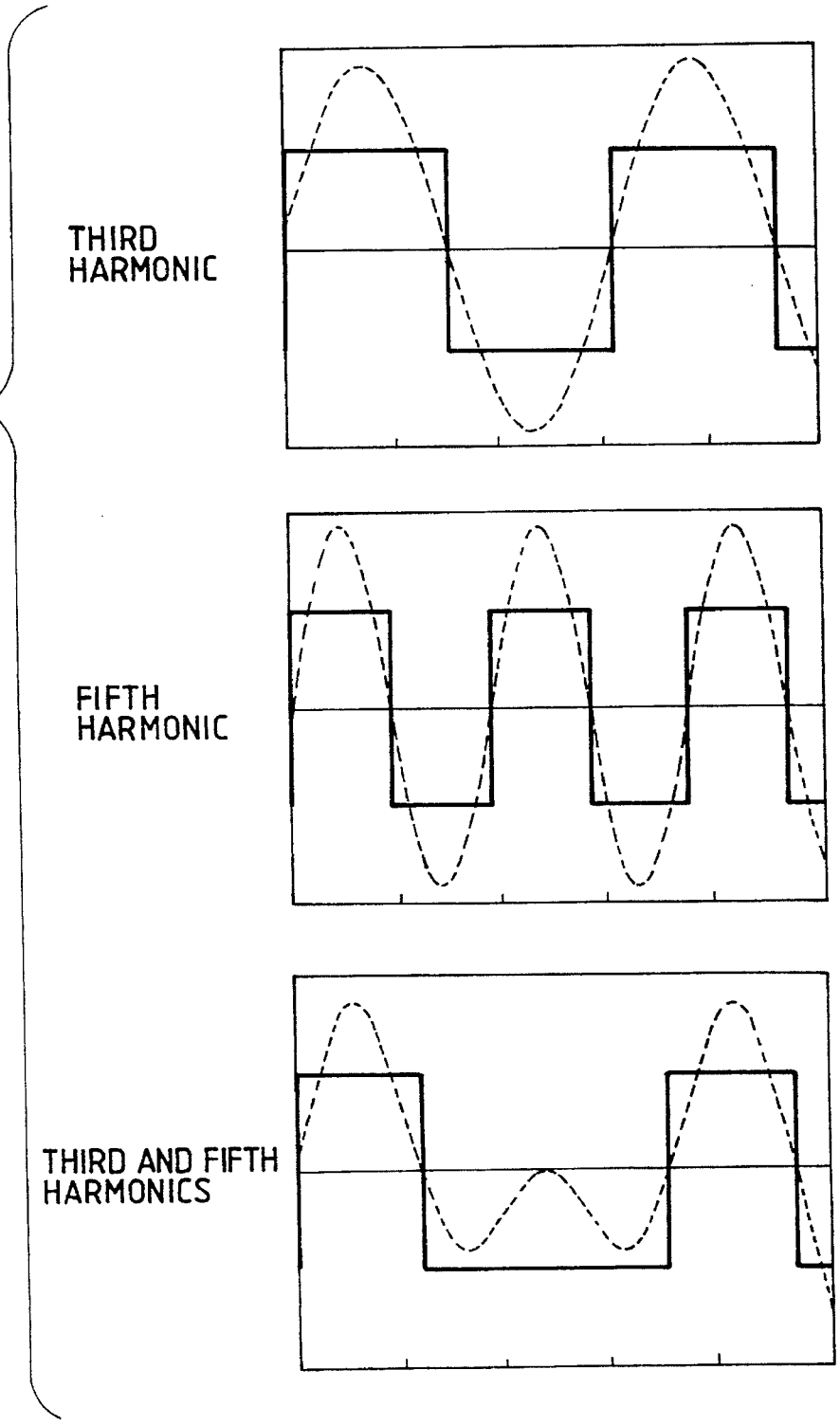
FIG. 31 shows graphically the waveforms of recording signals that were obtained when the magnetic layer in the magnetic marker fabricated in Example 5 were magnetized to produce rectangular magnetic patterns at intervals of 100/3 mm, 100/5 mm and a composite thereof.

A magnetic pattern consisting of a rectangular wave for generating a single resonant frequency can be produced by rectangular approximation of a sinusoidal wave as indicated by solid lines in FIG. 31. If a plurality of resonant frequencies need be obtained, one may use rectangular waves of different frequencies that are produced by rectangular approximation of a plurality of amplitude-composed sinusoidal waves as also shown in FIG. 31. Stated specifically, the curve of a sinusoidal magnetic pattern may be normalized to a rectangular wave by assigning "+1" when the symbol for the amplitude of that curve is positive and assigning "−" when it is negative. The amplitude of the thus normalized rectangular values with the alternating values "+1" and "−1" may be used as appropriate for the desired bias field strength. If necessary, these rectangular waves may be composed by high-frequency rectangular waves.

In order to produce a bias field according to the magnetic pattern, the coating (A) must typically be magnetized by a magnetic head to a depth equal to the thickness of the coating but then the head field which is produced in response to the current flowing through the magnetizing head is not necessarily linear since it is affected by the hysteresis of the magnetic material of which the head is made. In a case like this, the sinusoidal magnetic pattern used to magnetize the coating (A) will in practice consist of a deformed sinusoidal wave on account of the nonlinearity of the head field and, as a result, the metal (B) will vibrate in frequency modes other than that of the desired resonant frequency.

In contrast, with the magnetic pattern consisting of a rectangular wave, the nonlinearity of the head field causes no problem and the desired resonant frequency can be obtained as such. As a further advantage, the detection distance is extended since a higher signal output is insured at the resonant frequency.

In a more preferred embodiment, the bias field that is generated in the coating (A) by magnetization with a magnetic pattern may be of an optimal value that is determined by preliminary measurement of the field strength at which the magnetomechanical coupling coefficient which is defined by a numeral greater then zero but not exceeding one assumes the greatest value.

Figure 9:
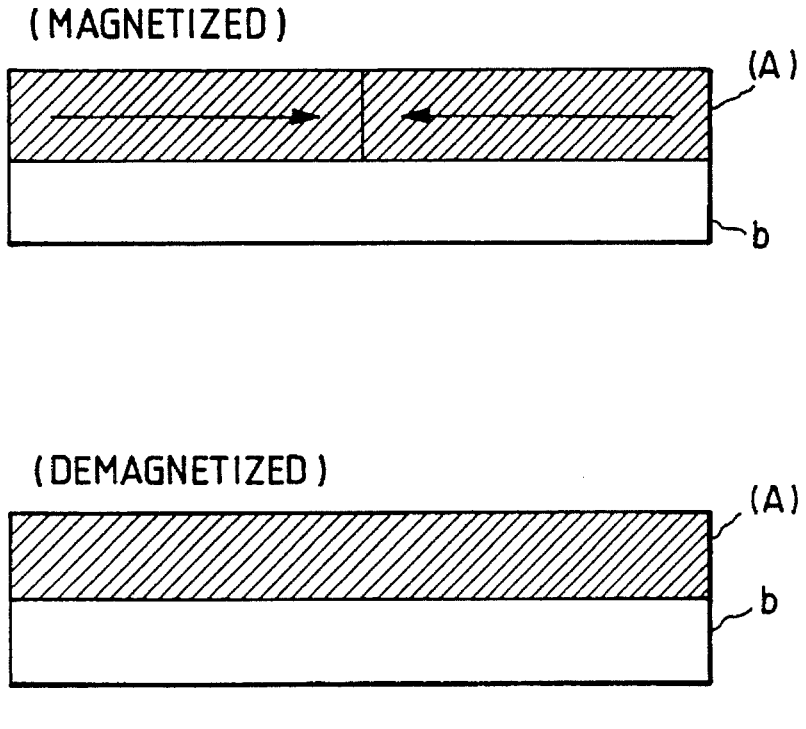
FIG. 9 schematically shows in section the essential part of the magnetic layer in the marker of the invention as it is magnetized (in the upper diagram) or demagnetized (in the lower diagram)

The magnetic layer is magnetized to produce the bias field as shown schematically in the upper diagram in FIG. 9 and it is demagnetized as shown in the lower diagram.

Figure 6:
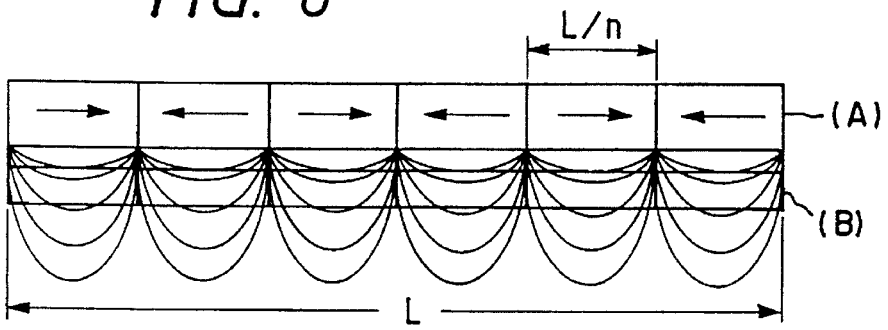
FIG. 6 is a diagram showing schematically how a magnetic layer of length L is magnetized in n equal portions to produce a bias field that is applied to a ductile strip of ferromagnetic and magnetostrictive material of length L.

FIG. 6 shows the case in which the coating (A) in the magnetic marker of the invention is magnetized with a magnetic pattern so that the coating (A) having length L is magnetized in n equal portions.

Figure 7:
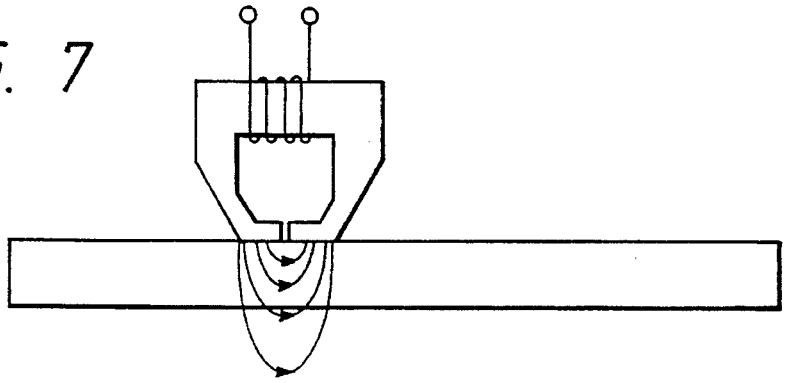
FIG. 7 is a schematic diagram showing an encoder.
Figure 8:
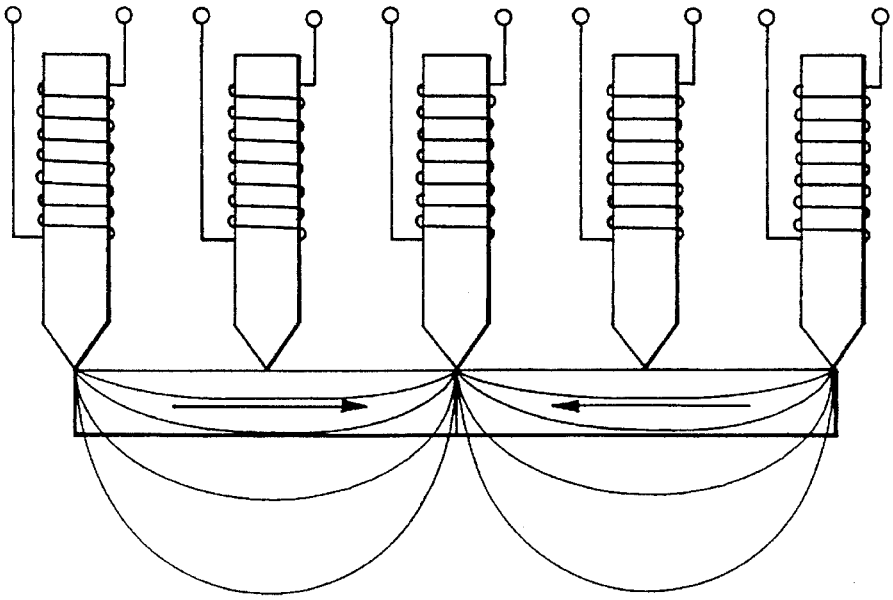
FIG. 8 is a schematic diagram showing a magnetizer.

To magnetize the coating (A) to generate a magnetic pattern, any known conventional device may be used, as exemplified by the magnetizer shown in FIG. 7 or the encoder shown in FIG. 8. Alternatively, a ring-type head for longitudinal recording may be used. Needless to say, these devices may also be used to demagnetize the magnetic layer so that the marker is no longer operable.

Figure 10:
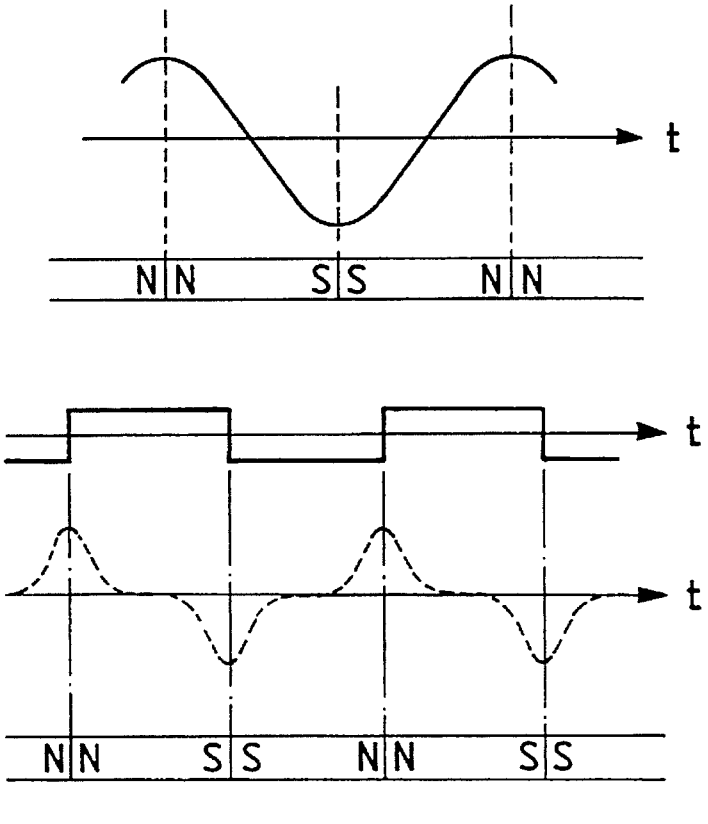
FIG. 10 shows graphically the waveform of the recording current for the case of encoding a sinusoidal magnetic pattern with a magnetic head (in the upper diagram), as well as the waveforms of the recording current (in solid line) and reproduction voltage (in dashed line) for the case of encoding a rectangular magnetic pattern with a magnetic head (in the lower diagram)

The magnetic layer may be magnetized with a magnetic pattern by using either a sinusoidal wave (see the upper diagram in FIG. 10) or a rectangular wave (see the lower diagram). The use of a rectangular wave is preferred for the following two reasons: the range of bias field in which the magnetomechanical coupling coefficient assumes the greatest value is narrow; and a stable and a sharp bias field can be produced at intervals of L/n.

While the foregoing description concerns the resonant frequency fn, the content of magnetization can be superposed so as to produce resonance in more than one mode. Producing resonance in more than one mode offers the advantage that the number of types of objects that can be distinguished is markedly increased by varying the combination of resonant modes.

To produce two resonant modes at the resonant frequencies fn and fm, one may perform pulse magnetizations by magnetizing rectangular waves so as to produce a bias field at the point where the amplitude of a curve obtained by composing two sinusoidal waves having the amplitude zero at either end of the metal (B), one having a wavelength twice the value of L/n and the other having a wavelength twice the value of L/m, is zero. In this case, resonant modes other than those at fn and fm may occur but this problem can be avoided by adjusting the amplitudes and other parameters of the two sinusoidal waves.

To produce three resonant modes at the resonant frequencies fn, fm and f1, one may similarly perform pulse magnetizations by magnetizing rectangular waves magnetization so as to produce a bias field at the point where the amplitude of a curve obtained by composing three sinusoidal waves, one having a wavelength twice the value of L/n, the second having a wavelength twice the value of L/m and the last having a wavelength twice the value of L/l, is zero.

The present invention also relates to an identification system that comprises a detection area for identification, an external alternating magnetic field producing means that is provided within the area and which performs sweeping through a range of frequencies to generate varying frequencies, a magnetic marker for use in the object identify system as attached to an object that is predestined to pass through the area, the marker comprising an assembly of a coating (A) that has been magnetized to have a magnetic pattern according to a bias field and a magnetostrictive metal (B) that will resonate mechanically at a predetermined frequency within the range of frequencies that are generated from the means within the area in such a way as to experience changes in flux density and permeability, the coating (A) and the metal (B) being in a superposed relationship so that the latter is capable of mechanical resonance, the magnetic marker being so adapted that the predetermined frequency at which the flux density or permeability changes is generated as an identification signal within the area according to the magnetic pattern provided in the coating (A) by magnetization, and means for detecting the resonance of the marker at the predetermined frequency which is generated from the means within the area the system thus responding to the presence of the marker within the area.

Any known conventional apparatus may be used as detection means for the marker of the invention and examples of such detection means are disclosed in Unexamined Published Japanese Patent Application (kokai) Sho 62-67485, 62-67486, 62-69183, 62-69184, 62-90039, etc. In the apparatus described in these patents, external alternating magnetic field producing means such as a magnetic field generator consisting of an ordinary coil and a power source is used to produce an alternating magnetic field having varying frequencies that is applied to the detection area. The frequencies vary from the smaller to the greater value or vice versa.

Figure 11:
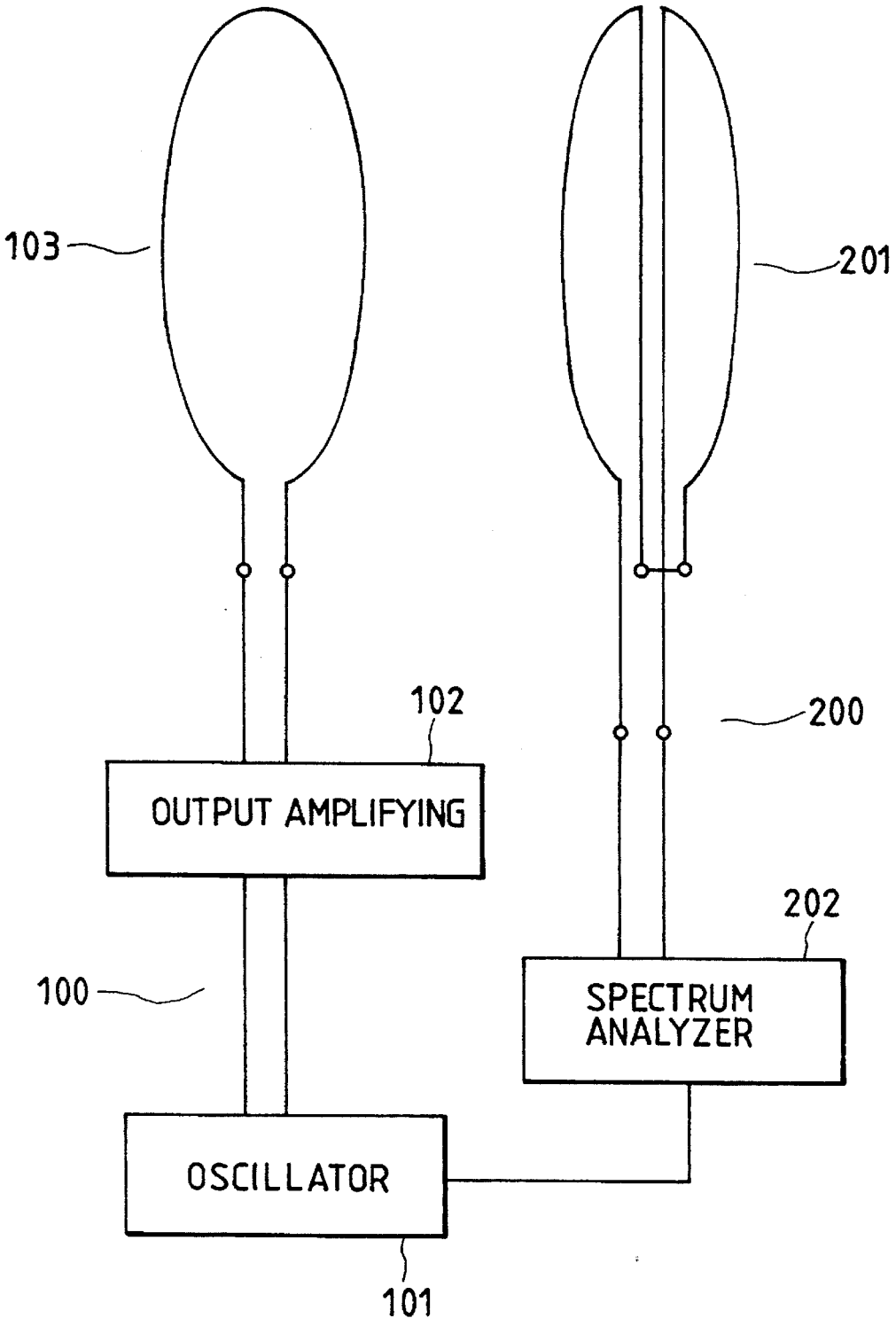
FIG. 11 is a sketch showing the layout of a system for use in detecting identification information according to the magnetic pattern in the magnetic marker of the invention.

FIG. 11 shows schematically a system for use in detecting identification information according to the magnetic pattern in the magnetic marker of the invention. Unit 100 is an example of the external alternating magnetic field producing means and consists of a oscillator 101 that generates a sinusoidal signal for sweeping through a range of frequencies, and output amplifier 102 for amplifying the sinusoidal signal, and an excitation coil 103 that receives the amplified sinusoidal signal and which is capable of applying an alternating magnetic field to the metal (B) in the magnetic marker. The unit 100 is provided within the detection area.

Unit 200 is an example of the detection means and consists of a pickup coil 201 provided concentrically within the excitation coil 103 and a spectrum analyzer 202 that is capable of measuring the amplitude of a response signal by detecting the frequency at which the metal (B) resonates mechanically. The coating (A) in the magnetic marker of the invention is preliminarily magnetized by such means as an encoder to have a magnetic pattern, so that the metal (B) in the marker resonates according to the magnetic pattern within the range of varying frequencies generated by the applied alternating magnetic field.

Therefore, if frequency sweeping is effected within the applied alternating magnetic field in which the magnetized marker with a magnetic pattern is present, the marker will issue a characteristic signal. If this signal is introduced into the magnetostrictive metal (B) in the marker which has been affected by the alternating magnetic field and the bias field that has been produced as a result of magnetization according to the magnetic pattern, the resulting energy is alternately stored and released as magnetic or mechanical energy depending upon the frequency of the alternating magnetic field. The stored or released magnetostrictive energy assumes the greatest value at the mechanical resonant frequency of the material of interest.

As a result of this energy storage and release, a voltage is induced in the pickup coil 201 via the change in the permeability of the metal (B), or its flux density. Thus, the identification information generated from the magnetic marker of the invention can be differentiated by detecting the characteristic frequency component of the output signal that is induced in the pickup coil 201.

The excitation frequency of the oscillator 101 and the detection frequency of the pickup coil 201 are both preferably within the range from 10 KHz to 5 MHz. The alternating magnetic field to be produced within the excitation coil 103 is preferably adjusted to 5 Oe or less and the field strength of this order is insufficient to erase or attenuate the magnetic pattern that has been generated by magnetization of the coating (A) in the marker of the invention.

Using the identification system of the invention, a variety of known and conventional objects including humans, animals, plants and other articles can be identified.

The invention will now be described in greater detail by means of working examples and comparative examples.

Preparation of Magnetic Paint

A hundred parts by weight of a magnetic metal powder "MAP-L" (product of KANTO DENKA KOGYO LTD.) having an average grain size of 0.4 μm, a coercive force of 680 Oe and a saturation flux density of 120 emu/g, 3 parts by wight of lecithin, 10 parts by weight of a vinyl chloride-vinyl acetate-vinyl alcohol terpolymer "VAGH" (product of Union Carbide Corporation, USA) and 10 parts by weight of a polyurethane elastomer "T-5206" (product of DAINIPPON INK & CHEMICALS, INC.) were kneaded with a kneader. To the kneaded product, 300 parts by weight of a liquid mixture consisting of equal weights of methyl ethyl ketone, toluene and cyclohexanone was added and dispersing was conducted in a ball mill to prepare a sample of magnetic paint.

EXAMPLE 1

The magnetic paint thus prepared was applied onto a polyester film (50 μm thick) to give a dry coating thickness of 30 μm. The coating was dried with the magnetic particles being oriented unidirectionally in a magnetic field of 2,000 gauss. Thereafter, the polyester film was cut along the direction of orientation into a strip 10 mm wide. Thus, a non-magnetic base carrying a magnetic layer 30 μm thick was obtained. The magnetostatic characteristics of the magnetic layer were measured and the results are shown in Table 2.

Using a conventional magnetizer, the magnetic layer was magnetized with a rectangular pattern at intervals of 25.0 mm as shown in FIG. 6. Thereafter, a magnetic head having a 20-μm gap was allowed to run along the polyester film of the strip at a speed of 190 mm/sec and the resulting reproduction output was measured. The result is shown in Table 2 as a substitute characteristic for the strength of a bias field.

Figure 3:
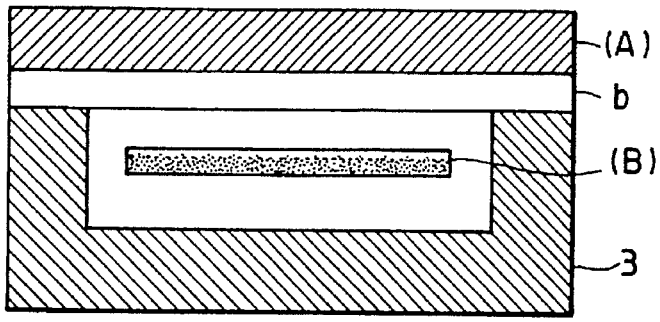
FIG. 3 is a schematic cross section of FIG. 2 taken along the line X–X'.

Using the non-magnetic base which carried the magnetic layer formed of the coating mentioned above, a marker having the cross-sectional shape shown in FIG. 3 was fabricated by the following procedure: "METGLAS 2605CO" (product of Allied-Signal Inc.) was cut into a strip 2 mm wide and 50 mm long; the strip was contained in a preliminarily constructed non-magnetic casing, which was brought into a superposed relationship with the magnetic layer carrying non-magnetic base; the two members were thermocompressed together to fabricate a marker in a strip form.

The marker was swept in an alternating magnetic field of 0.5 Oe through a frequency range of 60 to 100 KHz so as to check for the presence of the resonant frequency upon magnetization and demagnetization. The results are shown in FIG. 12 (for demagnetization) and FIG. 13 (for magnetization).

Figure 12:
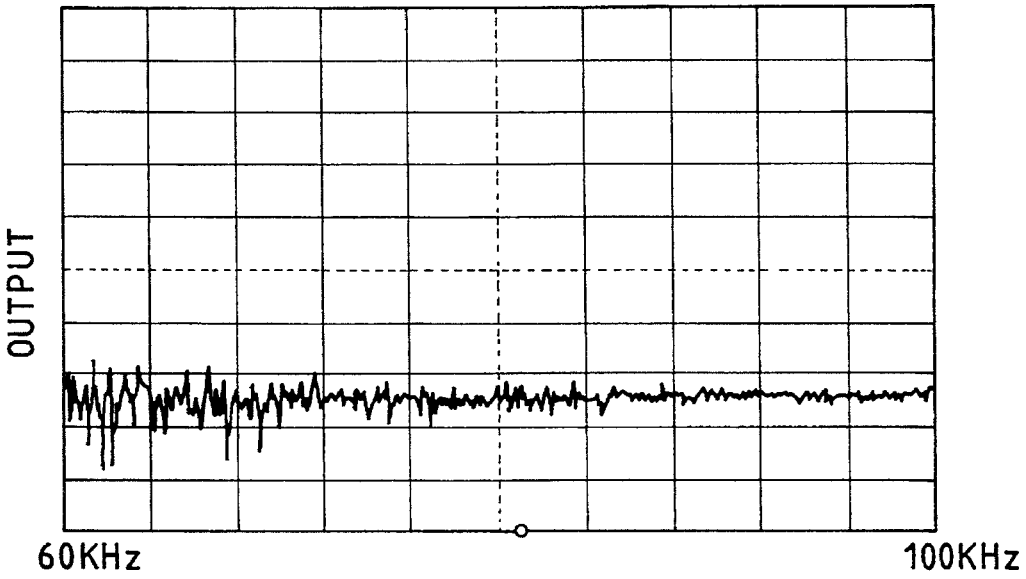
FIG. 12 is a graph showing that no resonant frequency was observed when the marker fabricated in Example 1 was placed in an applied external magnetic alternating field of varying frequencies after the magnetic layer was demagnetized.
Figure 13:
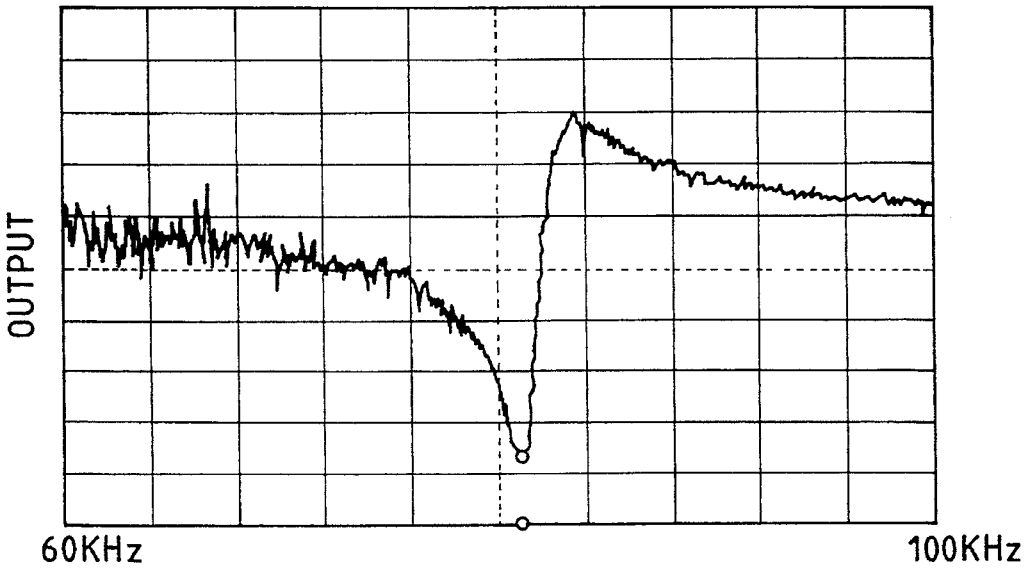
FIG. 13 is a graph showing that a resonant frequency was detected when the same marker was placed in an applied alternating magnetic field of varying frequencies after the magnetic layer was magnetized.

As FIG. 12 shows, the marker of Example 1 did not resonate mechanically at a predetermined frequency within the range of varying frequencies generated from an alternating magnetic field when the magnetic layer was not magnetized; hence, there were no sufficient changes in flux density or permeability to produce a signal output. On the other hand, when the magnetic layer was magnetized, the marker resonated mechanically at a predetermined frequency within the range of varying frequencies generated from the applied alternating magnetic field, thereby causing changes in flux density and permeability (see FIG. 13).

TABLE 2

| | Thickness of non-magnetic base | Thickness of magnetic layer | Coercive force | Residual flux (per unit width) | Squareness | Production output | Signal | |
|---|---|---|---|---|---|---|---|---|
| | μm | μm | Oe | Mx/cm | ratio | (V) | mag. | demag. |
| Example 1 | 50 | 30 | 645 | 6.5 | 0.84 | 3.0 | yes | no |

The abbreviations "mag" and "demag" in the lower part of the heading for the rightmost column of Table 2 means, respectively, the case where the magnetic layer was magnetized and the case where it was not magnetized but demagnetized. The higher the value of "reproduction output", the stronger the magnetic force that was produced. The term "squareness ratio" means flux anisotropy in the longitudinal direction of the magnetic layer in a strip form.

EXAMPLE 2

"METGLAS 2826MB" (Fe—Ni—Mo—B amorphous alloy of Allied Chemical Corporation) that was 25 μm thick was etched under a resist mask to prepare a ductile strip of ferromagnetic and magnetostrictive material that was 2 mm wide and 100 mm long.

Figure 14:
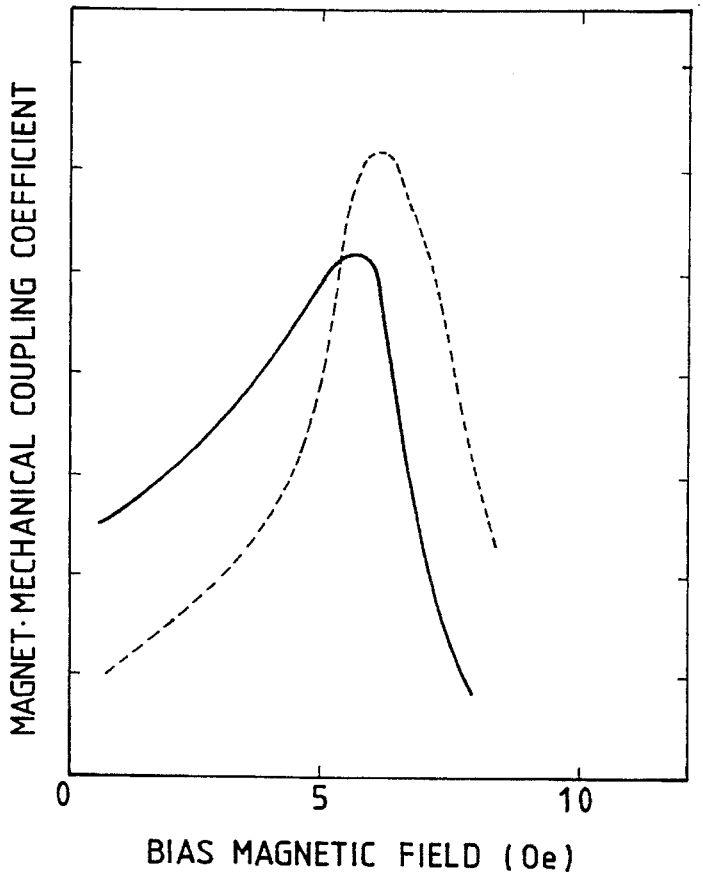
FIG. 14 is a graph showing the relationship between the magnetomechanical coupling coefficient of a ductile strip of ferromagnetic and magnetostrictive material and the magnitude of bias field, in which the solid line refers to the case of using "METGLAS 2826MB" as the ferromagnetic and magnetostrictive material (Example 1) and the dashed line refers to the case of using "METGLAS 2605CO" (Example 3)

The strip was measured for its ac magnetic characteristics with an ac magnetism meter (product of Riken Denshi Co., Ltd.) as excited at a frequency of 1 KHz and a maximum magnetic strength of 5 Oe. The results are shown in Table 4 and FIG. 23. The magnetomechanical coupling coefficient of the strip in an applied bias field was also measured by a mutual inductance method and the result is shown in FIG. 14.

A milk-white polyethylene terephthalate plate 250 μm thick was provided as a substrate sheet. A window 3 mm wide and 102 mm long was cut open in the sheet. The sheet was boded to another milk-white polyethylene terephthalate plate 250 μm thick. The ductile strip of ferromagnetic and magnetostrictive material was inserted into the cavity in such a way that it was capable of mechanical resonance. Thus, a casing was fabricated that contained the ductile strip of ferromagnetic and magnetostrictive material.

A hundred parts by weight of a magnetic metal powder "HJ-8" (product of DOWA MINING CO., LTD.) having a coercive force of 1,550 Oe and a saturation flux density of 120 emu/g, 3 parts by weight of lecithin, 10 parts by weight of a vinyl chloride-vinyl acetate-vinyl alcohol terpolymer "VAGH" (product of Union Carbide Corporation, USA) and 10 parts by weight of a polyurethane elastomer "T-5206" (product of DAINIPPON INK & CHEMICALS, INC.) were kneaded with a kneader. To the kneaded product, 300 parts by weight of a liquid mixture consisting of equal weights of methyl ethyl ketone, toluene and cyclohexanone was added and dispersing was conducted in a ball mill to prepare a sample of magnetic paint.

The magnetic paint thus prepared was applied onto a polyester film (50 μm thick) to give a dry coating thickness of 12.5 μm (1) or 30 μm (2). The coatings were dried under orientation in a magnetic field of 5,000 gauss. Thereafter, the polyester film were each slit to a width of 10 mm, thereby preparing non-magnetic bases each carrying a magnetic layer. The remaining portion of the magnetic paint was applied onto a polyester film (50 μm thick) to give a dry coating thickness of 30 μm. The magnetic paint was also applied onto another polyester film (24 μm thick) to give a dry coating thickness of 10 μm. Both coatings were dried under orientation in a magnetic field of 5,000 gauss, slit to a width of 10 mm and bonded together to prepare a non-magnetic base carrying a magnetic layer 40 μm thick (3). The three magnetic layers thus prepared were measured for their magnetostatic characteristics and the results are shown in Table 3.

The previously prepared casing was thermally pressed onto each of the three non-magnetic bases carrying a magnetic layer in such a way that the ductile strip of ferromagnetic and magnetostrictive material was brought into a superposed relationship with the non-magnetic base. The assemblies were then punched to a size of 5×105 mm, thereby producing markers in the form of a magnetic card according to the invention.

Figure 15:
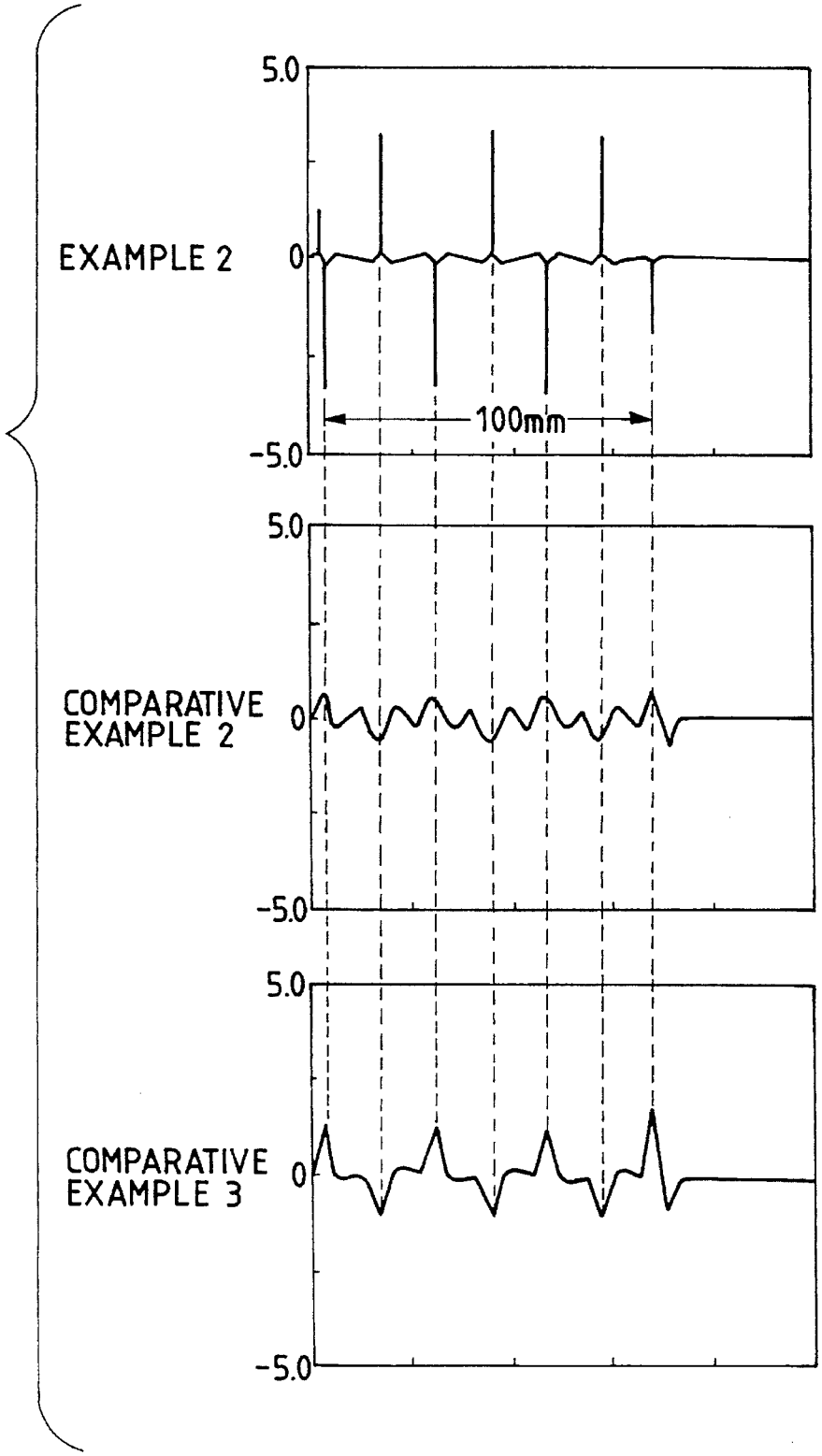
FIG. 15 shows graphically the waveforms of reproduction outputs that were obtained when the magnetic layers in the magnetic markers fabricated in Example 1 and Comparative Examples 2 and 3 were magnetized to have magnetic patterns at intervals of 100/6 mm.
Figure 19:
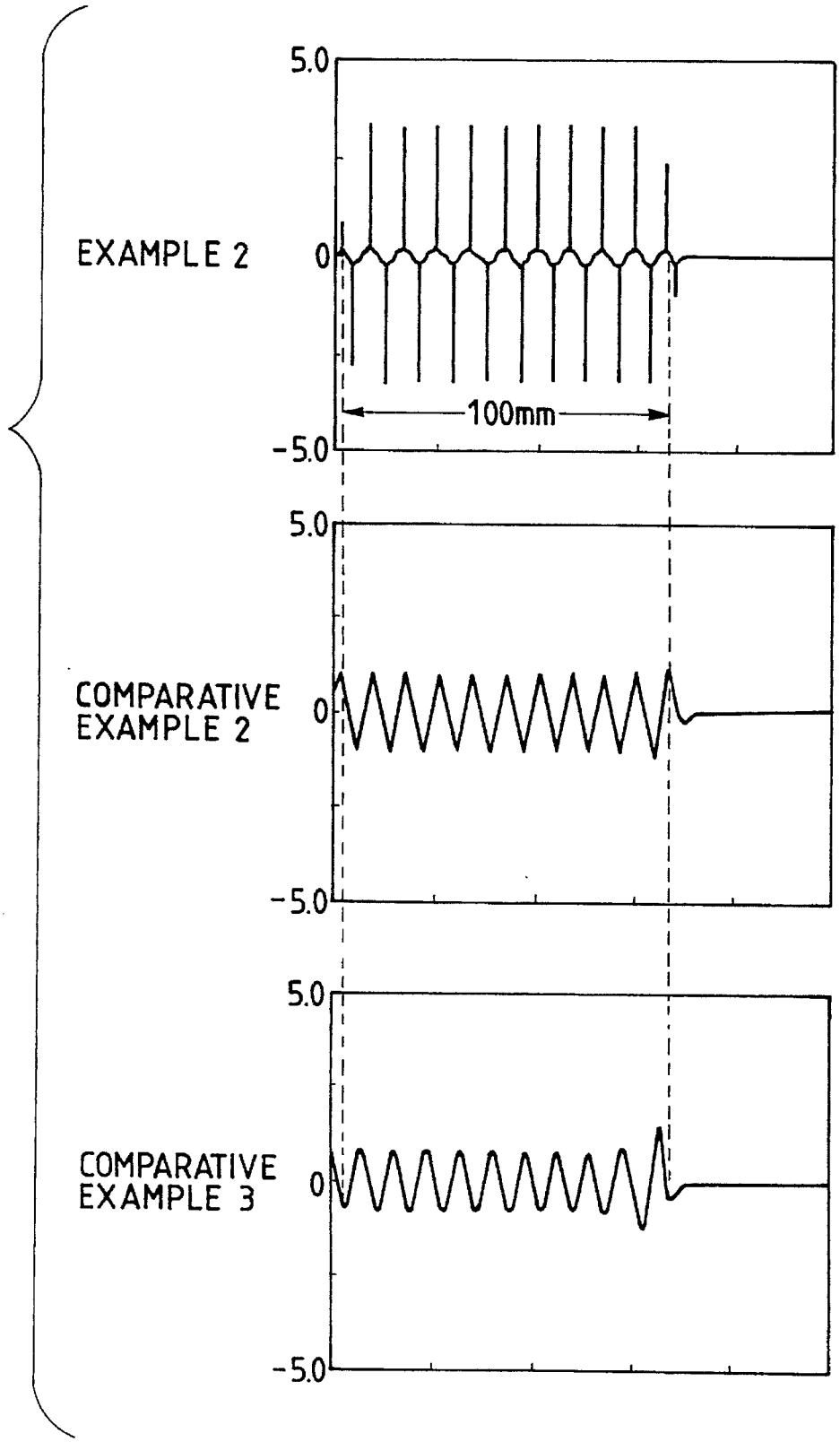
FIG. 19 shows graphically the waveforms of reproduction outputs that were obtained when the magnetic layers in the magnetic markers fabricated in Example 2 and Comparative Examples 2 and 3 were magnetized to have magnetic patterns at intervals of 100/20 mm.
Figure 20:
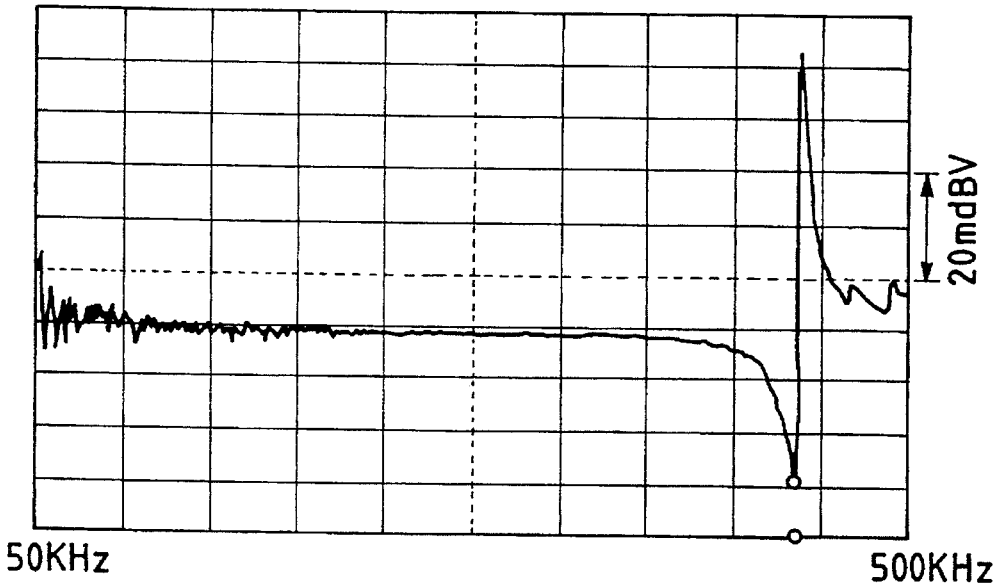
FIG. 20 is a graph showing the result of detecting the signal of a twentieth harmonic generated from the magnetic marker fabricated in Example 2.

The magnetic marker having the magnetic layer in a thickness of 40 μm (3) was magnetized with an encoder to insure saturation magnetization with writing a rectangular wave pattern at intervals of 100/6 mm, 100/12 mm and 100/20 mm so that sixth, twelfth and twentieth harmonics would be generated from an end face of the ductile strip of ferromagnetic and magnetostrictive material. Then, the reproduction output from the marker was measured with a reader using a conventional magnetic head. The results are shown in FIGS. 15 and 19. In addition, the bias field produced from the side of the magnetic layer that was in contact with the ductile strip of ferromagnetic and magnetostrictive material was measured with a gaussmeter and the result is shown in Table 3.

At the next stage, a system capable of detecting identification information according to the magnetic pattern in the marker was fabricated by the following procedure. The system layout is shown in FIG. 11.

Figure 25:
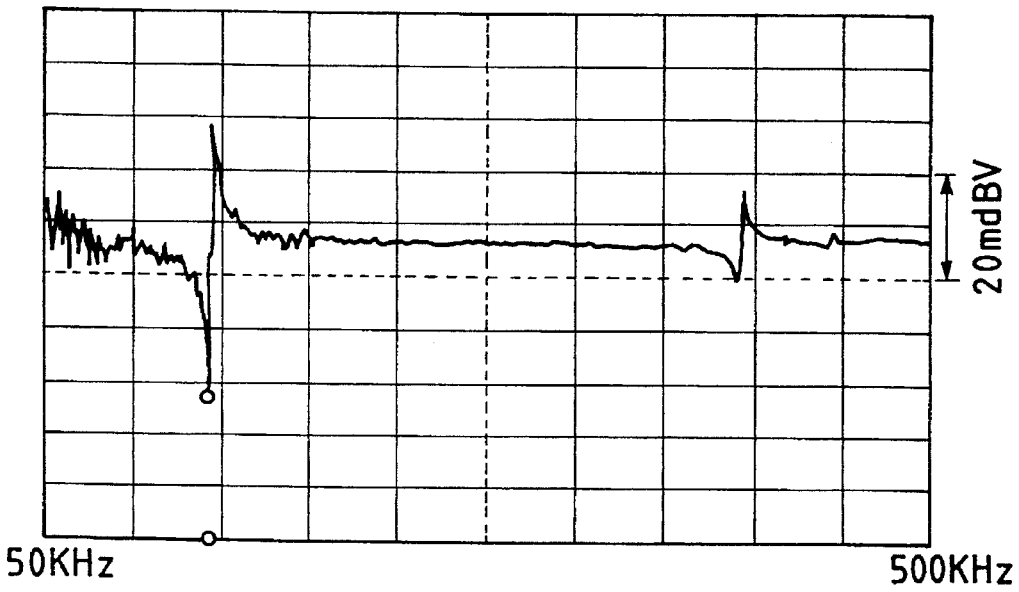
FIG. 25 is a graph showing the result of detecting the signal of a sixth harmonic generated when an alternating magnetic field of varying frequencies was applied to the magnetic marker fabricated in Example 2.
Figure 26:
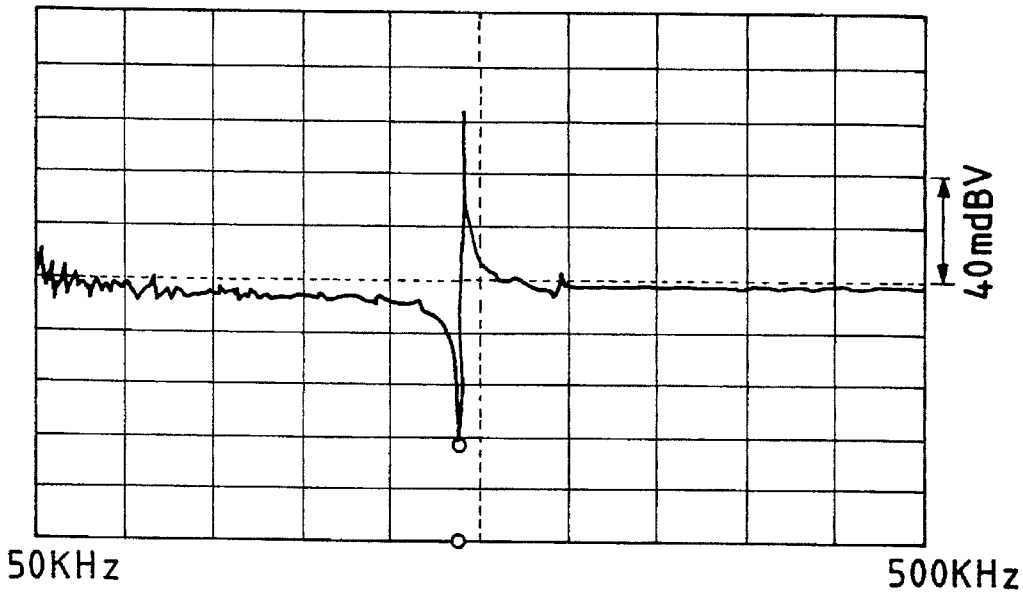
FIG. 26 is a graph showing the result of detecting the signal of a twelfth harmonic generated when an alternating magnetic field of varying frequencies was applied to the magnetic marker fabricated in Example 2.
Figure 27:
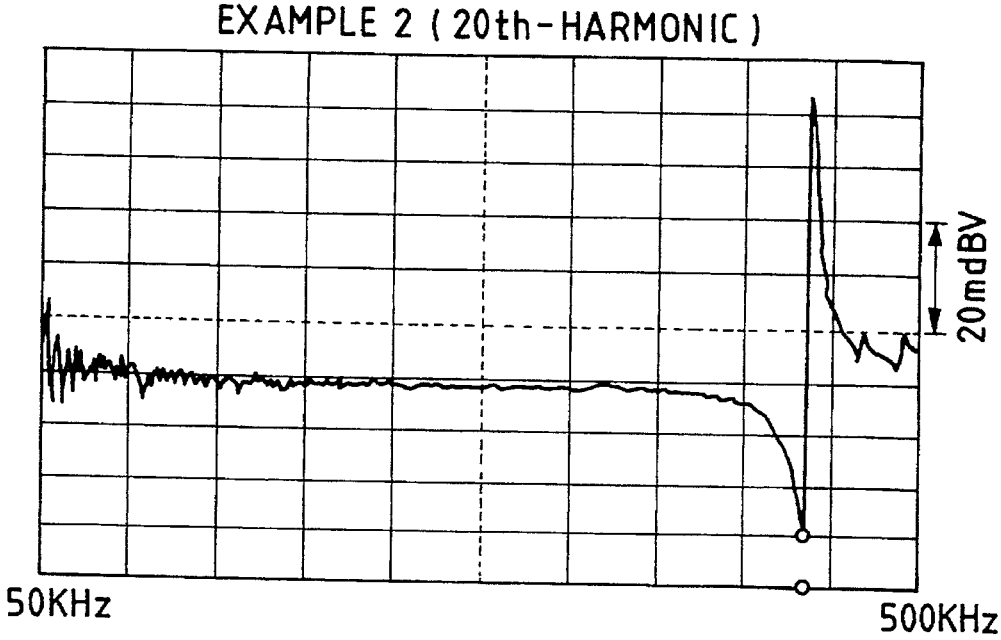
FIG. 27 is a graph showing the result of detecting the signal of a twentieth harmonic generated when an alternating magnetic field of varying frequencies was applied to the magnetic marker fabricated in Example 2.

A copper wire (1 mm$^{\Phi}$) was wound in 200 turns around a core (i.d. 60 mm) to make an excitation coil. A copper wire (0.1 mm$^{\Phi}$) was wound in 50 turns around a core (i.d. 10 mm) to make a differential pickup coil, which was inserted into the excitation coil. The two coils were connected to a gain phase analyzer ("4194A" of Y.H.P. Corp.) and the magnetic marker was inserted into the pickup coil. An applied alternating magnetic field was swept through a frequency range of 50 to 500 KHz and the resonant frequency of the sixth harmonic and its signal output were measured. The results are shown in Table 5. In addition, the sixth, twelfth and twentieth harmonics were measured and the results are shown in FIGS. 25 to 27, respectively.

EXAMPLE 3

The magnetic paint was applied onto a polyester film (100 μm thick) to give a dry coating thickness of 30 μm (4). The coating was dried under orientation in a magnetic field of 5,000 gauss. The polyester film was slit to a width of 10 mm to prepare a non-magnetic base carrying a magnetic layer. The magnetic paint was also applied onto a polyester film ( 100 μm thick) to give a dry coating thickness of 30 μm. In a separate step, the paint was applied onto a polyester film (24 μm thick) to give a dry coating thickness of 15 μm or 30 μm. Both coatings were dried under orientation in a magnetic field of 5,000 gauss and the polyester films were slit to a width of 10 mm and bonded together to prepare a non-magnetic base carrying a magnetic layer 45 μm thick (5) or 60 μm (6). The three magnetic layers thus prepared were measured for their magnetostatic characteristics and the results are shown in Table 3.

Using the thus prepared non-magnetic bases each carrying a magnetic layer, markers were fabricated as in Example 2 according to the invention and the results of bias field measurement are shown in Table 3. Measurements were also conducted for resonant frequencies and their signal outputs and the results are shown in Table 5.

EXAMPLE 4

"METGLAS 2605Co" (Fe—Co—B—Si amorphous alloy of Allied Chemical Corporation) was etched as in Example 2 to prepare a ductile strip of ferromagnetic and magnetostrictive material. The strip was thereafter measured for its ac magnetic characteristics as in Example 2 and the results are shown in Table 4 and FIG. 24. The magnetomechanical coupling coefficient of the strip in an applied bias field was also measured by a mutual inductance method and the result is shown in FIG. 14.

A non-magnetic base carrying a magnetic layer was prepared as in Example 2 except that the thickness of the magnetic layer was 40 μm. The results of measurements of the magnetostatic characteristics of the magnetic layer are shown in Table 4.

Figure 28:
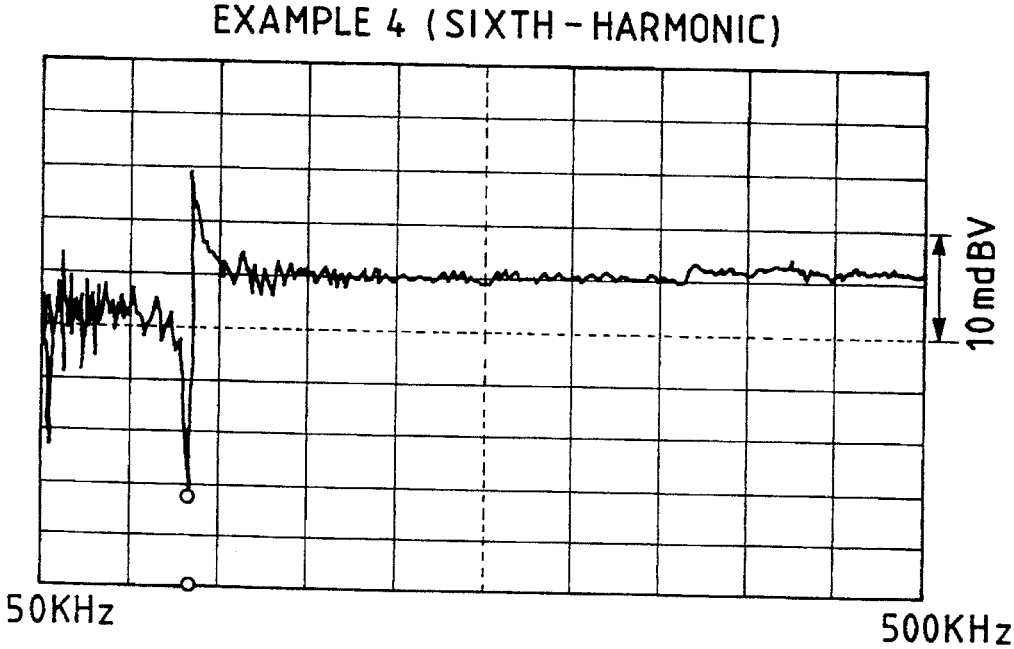
FIG. 28 is a graph showing the result of detecting the signal of a sixth harmonic generated when an alternating magnetic field of varying frequencies was applied to the magnetic marker fabricated in Example 4.
Figure 29:
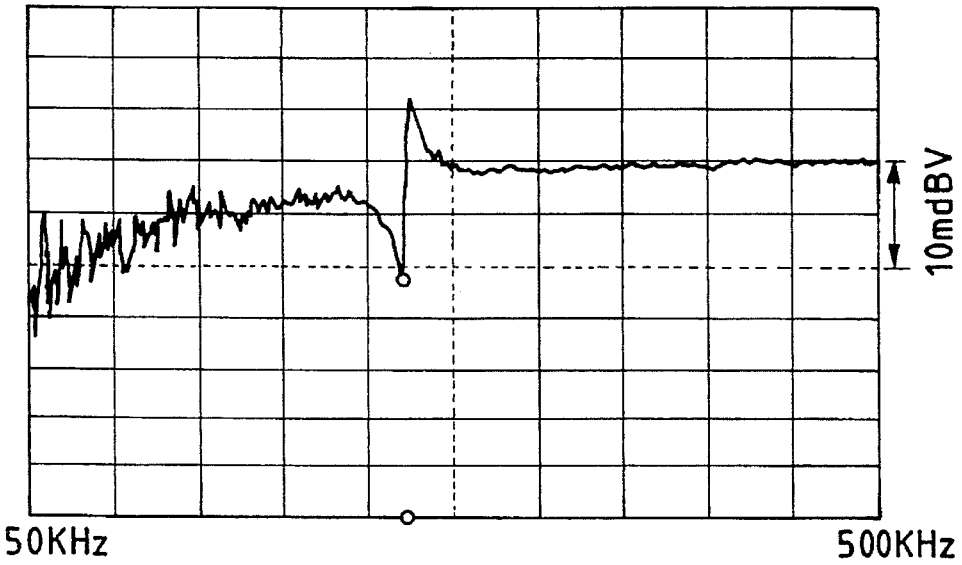
FIG. 29 is a graph showing the result of detecting the signal of a twelfth harmonic generated when an alternating magnetic field of varying frequencies was applied to the magnetic marker fabricated in Example 4.
Figure 30:
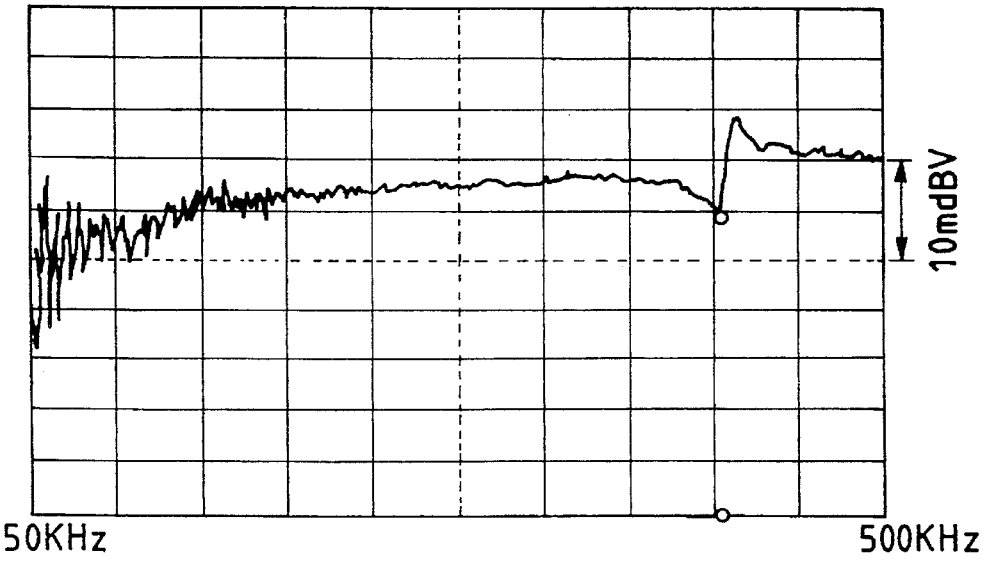
FIG. 30 is a graph showing the result of detecting the signal of a twentieth harmonic generated when an alternating magnetic field of varying frequencies was applied to the magnetic marker fabricated in Example 4.

Using the previously prepared ductile strip of ferromagnetic and magnetostrictive material, a magnetic marker was fabricated and the sixth, twelfth and twentieth harmonics it generated were measured; the results are shown in FIGS. 28 to 30, respectively.

EXAMPLE 5

The separately prepared magnetic paint was applied onto a polyester film (50 μm thick) to give a dry coating thickness of 30 μm. The magnetic paint was also applied to a polyester film (24 μm thick) to give a dry coating thickness of 10 μm. Both coatings were dried under orientation in a magnetic field of 5,000 gauss and the polyester films were slit to a width of 10 mm and bonded together to prepare a non-magnetic base carrying a magnetic layer in a thickness of 40 μm (3).

Figure 32:
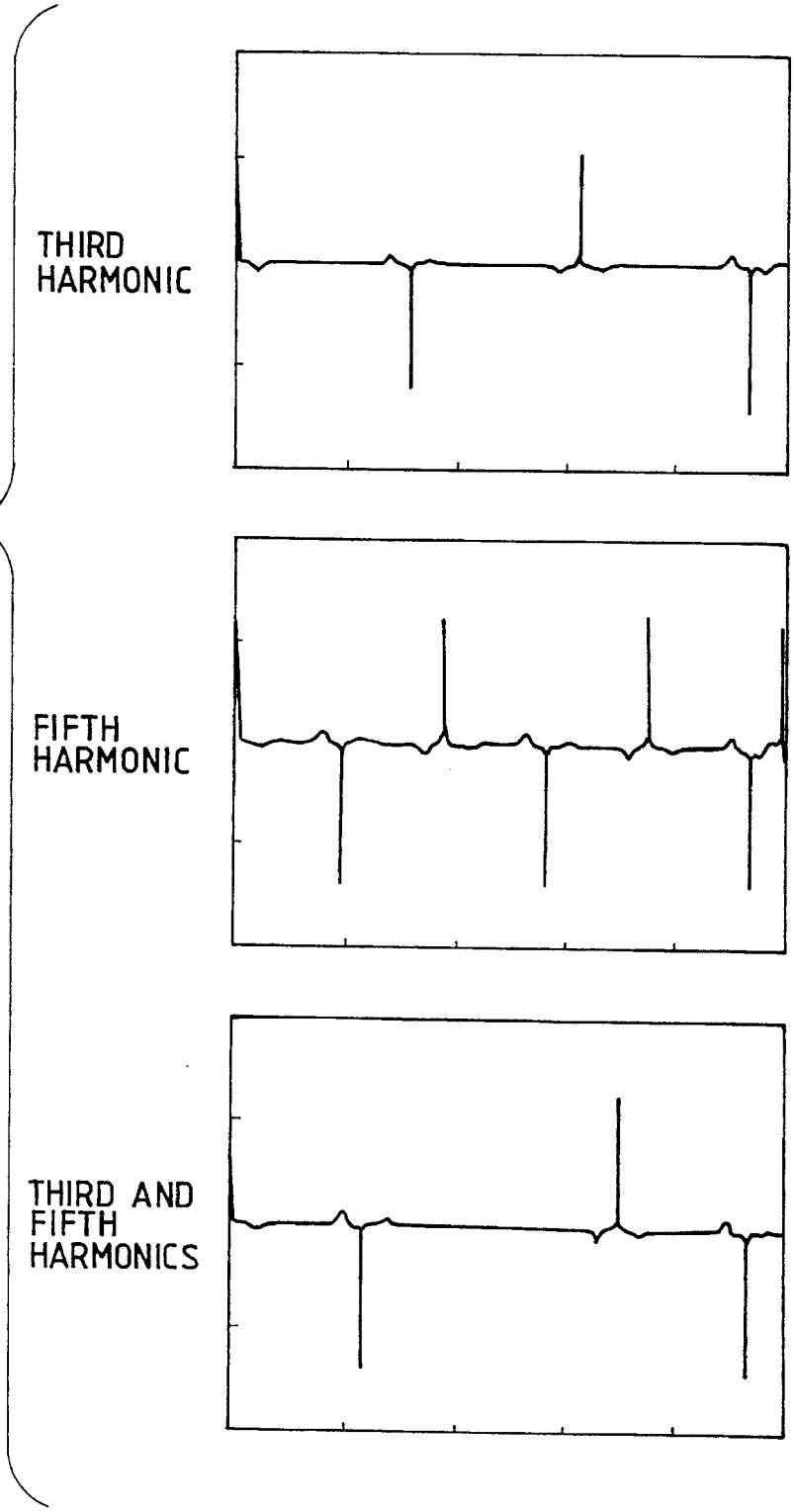
FIG. 32 shows a graphically the waveforms of reproduction outputs that were obtained when the magnetic layer in the magnetic marker fabricated in Example 5 were magnetized to produce rectangular magnetic patterns at intervals of 100/3 mm, 100/5 mm and a composite thereof.
Figure 33:
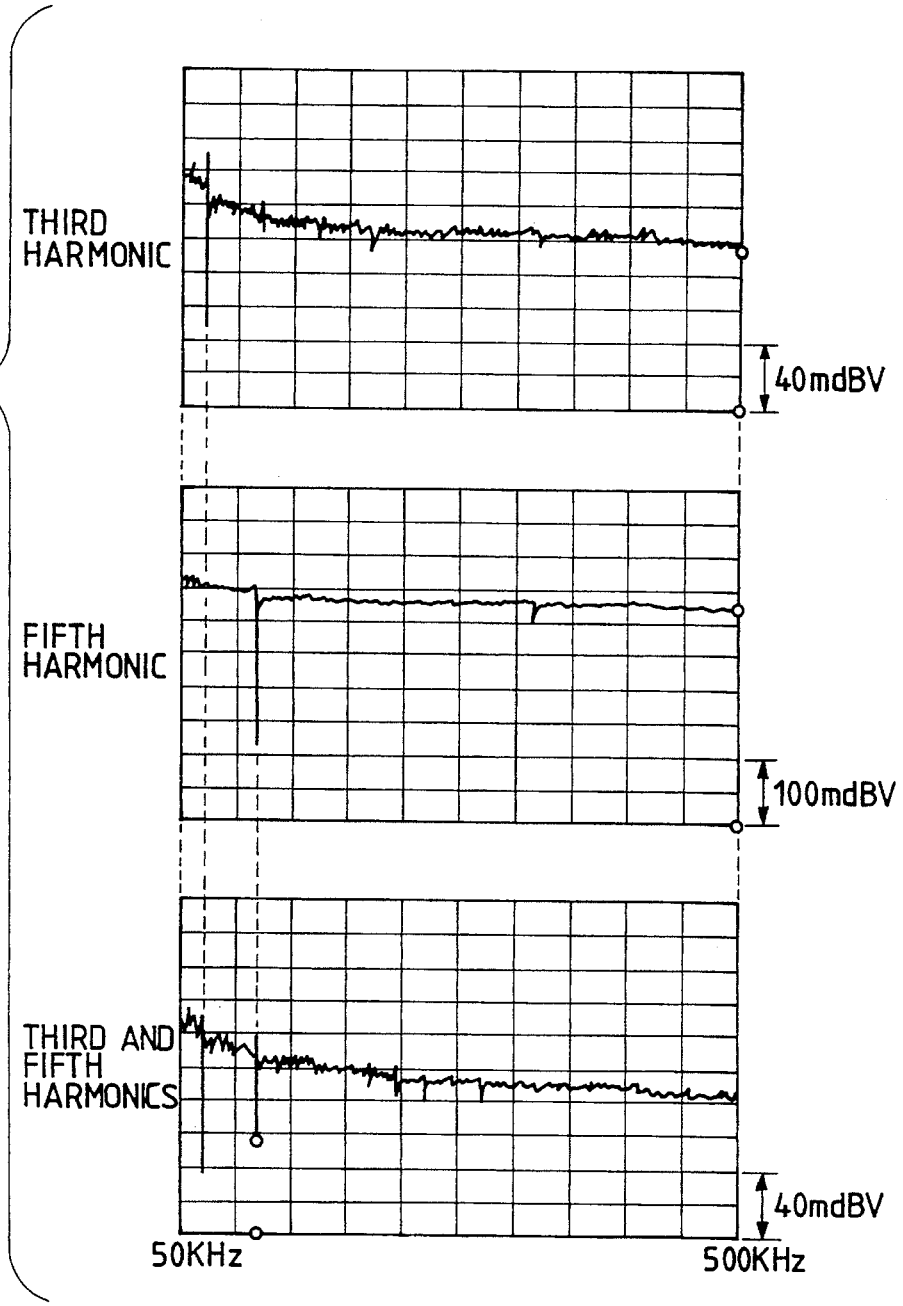
FIG. 33 shows graphically the results of detecting the signals of a third harmonic, a fifth harmonic and the composite of those two harmonics that were generated when an alternating magnetic field of varying frequencies was applied to the magnetic marker fabricated in Example 5.

Using the thus prepared non-magnetic base carrying a magnetic layer, a magnetic marker was fabricated as in Example 2 according to the invention and magnetized with an encoder to insure saturation magnetization with writing a rectangular wave pattern at intervals of 100/3 mm and 100/5 mm so that third and fifth harmonics would be generated from an end face of the ductile strip of ferromagnetic and magnetostrictive material. The marker was also magnetized with an encoder in such a way that sinusoidal waves having wavelengths twice the intervals of 100/3 mm and 100/5 mm were composed so that a rectangular pattern of saturation magnetization is located at intervals where the amplitude of the composition wave being zero. Then, the reproduction output from the marker was measured with a reader using a conventional magnetic head. The results are shown in FIGS. 31 and 32. In addition, the resonant frequencies of the respective harmonics and their signal outputs were measured and the results are shown in FIG. 33.

EXAMPLE 6

Figure 34:
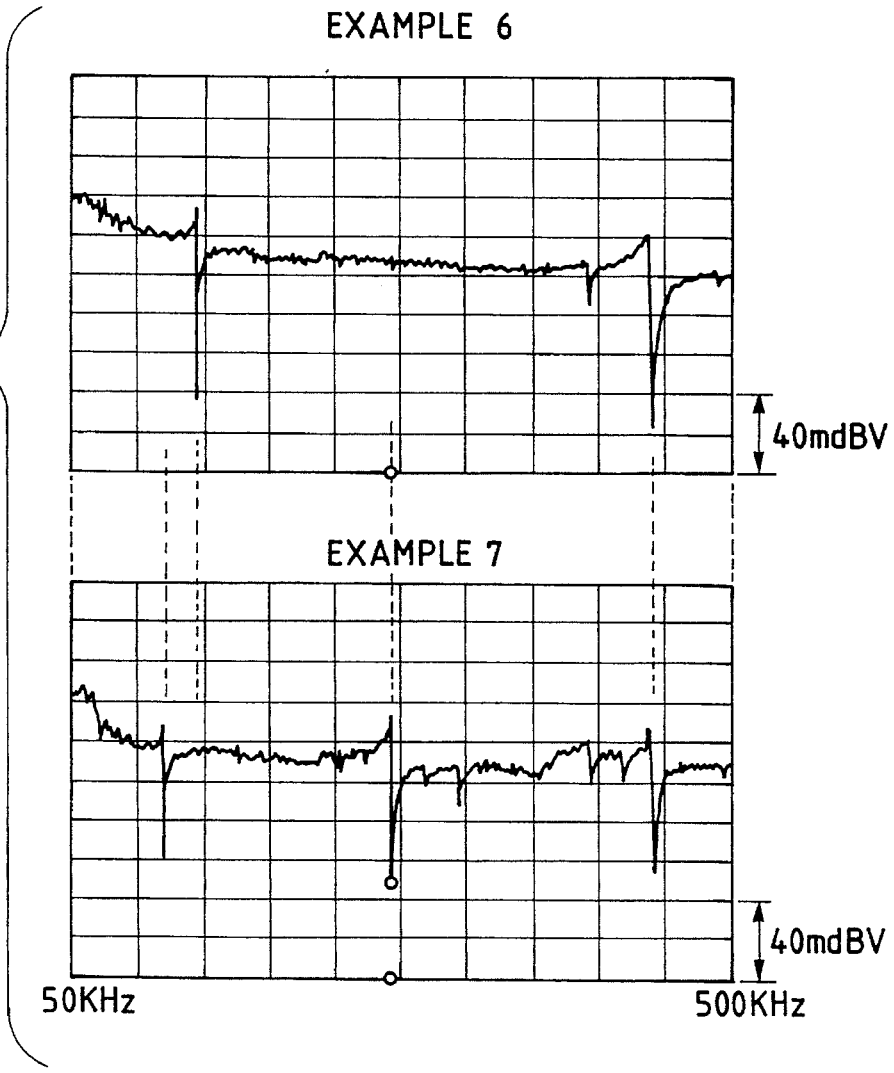
FIG. 34 shows graphically the results of detecting the signals of a sixth and a twentieth harmonic that were generated when an alternating magnetic field of varying frequencies was applied to the magnetic marker fabricated in Example 6 (in the upper diagram), as well as the results of detecting the signals of a fifth, a twelfth and a twentieth harmonic that were generated when an alternating magnetic field of varying frequencies was applied to the magnetic marker fabricated in Example 7 (in the lower diagram)

A magnetic marker was fabricated as in Example 4 except that it was magnetized with an encoder by rectangular wave pattern. The rectangular wave pattern can be obtained in such a way that magnetization is saturated at intervals where the amplitude of a composition wave, that is composed sinusoidal waves having ½ wave length of 100/6 mm and 100/20 mm, being zero. Thereby assuring that sixth and twentieth harmonics would be generated from an end face of the ductile strip of ferromagnetic and magnetostrictive material. The resonant frequencies of the respective harmonics and their signal outputs were measured and the results are shown in FIG. 34.

EXAMPLE 7

A magnetic marker was fabricated as in Example 4 except that it was magnetized with an encoder by rectangular wave pattern. The rectangular wave pattern can be obtained in such a way that magnetization is saturated at intervals where the amplitude of a composition wave, that is composed sinusoidal waves having ½ wave length of 100/5 mm, 100/12 mm and 100/20 mm, being zero. Thereby assuring that fifth, twelfth and twentieth harmonics would be generated from an end face of the ductile strip of ferromagnetic and magnetostrictive material. The resonant frequencies of the respective harmonics and their signal outputs were measured and the results are shown in FIG. 34.

EXAMPLE 8

"METGLAS 2826MB" (Fe—Ni—Mo—B amorphous alloy of Allied Chemical Corporation) that was 25 μm thick was etched under a resist mask to prepare a ductile strip of ferromagnetic and magnetostrictive material that was 2 mm wide and 75 mm long.

A milk-white polyethylene terephthalate plate 250 μm was provided as a substrate sheet. A window 3 mm wide and 76 mm long was cut open in the sheet. The sheet was bonded to another milk-white polyethylene terephthalate plate 250 μm thick. The ductile strip of ferromagnetic and magnetostrictive material was inserted into the cavity in such a way that it was capable of mechanical resonance. Thus, a casing was fabricated that contained the ductile strip of ferromagnetic and magnetostrictive material.

The separately prepared magnetic paint was applied onto a polyester film (50 μm thick) to give a dry coating thickness of 30 μm. The paint was also applied onto another polyester film (24 μm thick) to give a dry coating thickness of 10 μm. Both coatings were dried under orientation in a magnetic field of 5,000 gauss and the polyester films were slit to a width of 10 mm and bonded together to prepare a non-magnetic base carrying a magnetic layer in a thickness of 40 μm (3).

The previously prepared casing was thermally pressed onto the non-magnetic base carrying a magnetic layer in such a way that the ductile strip of ferromagnetic and magnetostrictive material was brought into a superposed relationship with the non-magnetic base. The assembly was punched to a size of 54×85.5 mm, thereby producing a magnetic marker according to the invention.

The magnetic marker having the magnetic layer in a thickness of 40 μm (3) was magnetized with an encoder by rectangular wave pattern. The rectangular wave pattern can be obtained in such a way that magnetization is saturated at intervals where the amplitude of a composition wave, that is composed sinusoidal waves having ½ wave length of 75/3 mm and 75/7 mm, being zero. Thereby assuring that third and seventh harmonics would be generated from an end face of the ductile strip of ferromagnetic and magnetostrictive material. The marker was also encoded with an encoder in such a way that sinusoidal waves having wavelengths twice the intervals of 75/3 mm and 75/7 mm were composed by amplitude combinations of 1/1, 1/0.9 and 1/0.8 so that a rectangular pattern of saturation magnetization is located at intervals where the amplitude of the composition wave being zero, thereby producing a rectangular pattern of saturation magnetization at intervals for zero amplitude.

At the next stage, a system capable of detecting identification information according to the magnetic pattern in the magnetic marker was fabricated by the following procedure. The system layout is shown in FIG. 11.

Figure 35:
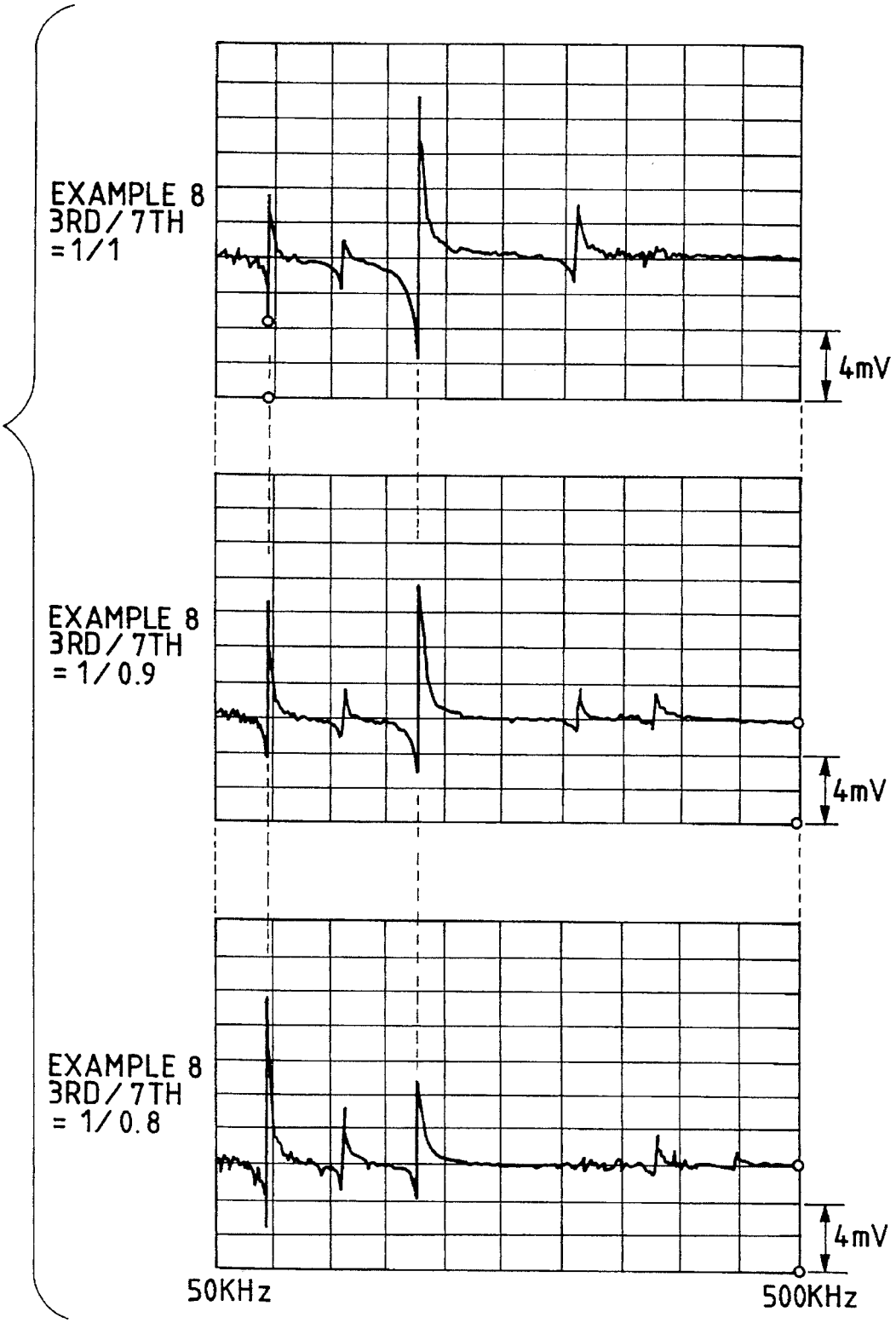
FIG. 35 shows graphically the results of detecting in the case where an alternating magnetic field of varying frequencies was applied to the magnetic marker fabricated in Example 8 to produce third and seventh harmonics. The top diagram shows a detection result in case of that the marker is magnetized by rectangular waves on the basis of a curve composed sinusoidal waves corresponding to third and seventh harmonics by 1/1 ratio in amplitude. The center and the bottom diagrams are in cases of 1/0.9 and 1/0.8 ratios, respectively.

A copper wire (1 mmϕ) was wound in 20 turns around a core (i.d. 250 mm×500 mm) to make an excitation coil. A copper wire (1 mmϕ) was wound in 20 turns around a core (i.d. 250 mm×250 mm) to make a differential search coil. Another search coil was made by the same method. The two search coils were arranged in the shape of figure "eight" and spaced from the excitation coil by a distance of 200 mm to provide a detection area. These coils were connected to a gain phase analyzer ("4194A" of Y.H.P. Corp.) cia a high-speed, high-band dc amplifier and differential amplifier. The magnetic marker was inserted into the detection area and an applied alternating magnetic field was swept through a frequency range of 50 to 500 KHz. The resonant frequencies of the superposed harmonics and their signal outputs were measured and the results are shown in FIG. 35.

Comparative Example 1

Non-magnetic base each carrying a magnetic layer were prepared as in Example 2, except that the magnetic metal powder was replaced by a magnetic iron oxide powder ("CTX-970" of TODA KOGYO CORP.) having a coercive force of 650 Oe and a saturation flux density of 73 emu/g. The magnetic layers were measured for their magnetostatic characteristics and the results are shown in Table 3.

Using the thus prepared non-magnetic bases carrying the magnetic layers, magnetic markers were fabricated as in Example 2 and the result of bias field measurement is shown in Table 3. In addition, the resonant frequency of a sixth harmonic and its signal output were measured and the results are shown in Table 5. As the data for bias field in Table 3 show, the signal output from the magnetic layer 12.5 μm thick was undetectable and the output levels for the other thicknesses were generally low.

Comparative Example 2

A non-magnetic base was prepared as in Example 2, except that the magnetic layer was replaced by a ferromagnetic metal ribbon (Co—Fe—Ni semi-hard material manufactured by Vacuumschmelze GmbH, Germany) that had a thickness of 33 μm. The ferromagnetic ribbon was measured for its magnetostatic characteristics and the results are shown in Table 3.

Figure 17:
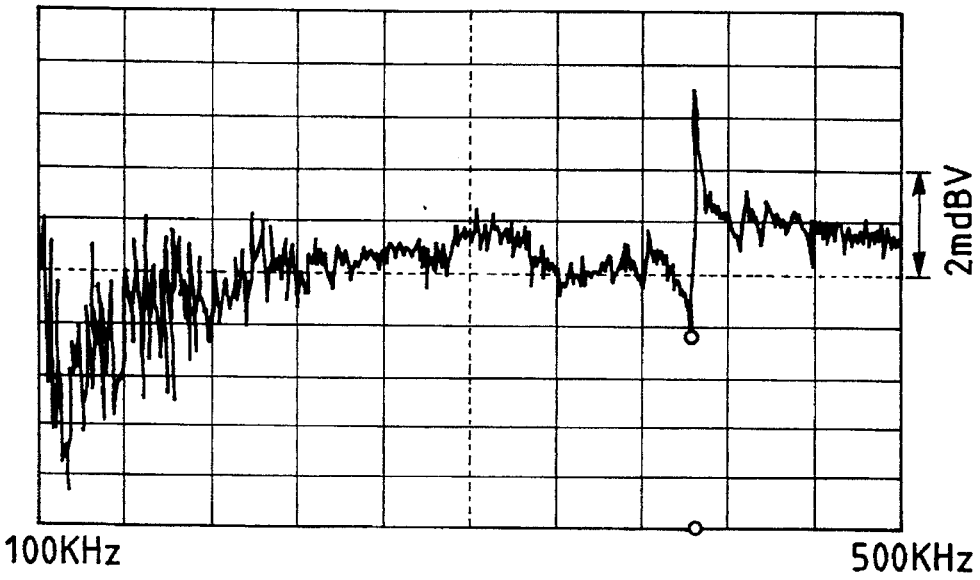
FIG. 17 is a graph showing the result of detecting the signal of a sixth harmonic generated from the magnetic marker fabricated in Comparative Example 2.
Figure 21:
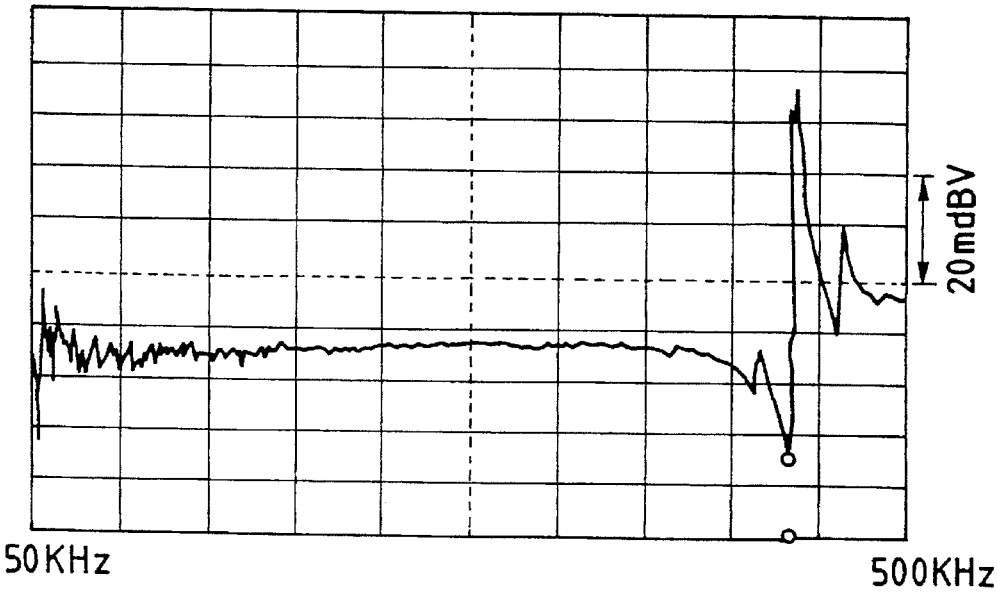
FIG. 21 is a graph showing the result of detecting the signal of a twentieth harmonic generated from the magnetic marker fabricated in Comparative Example 2.

Using the thus prepared non-magnetic base carrying the ferromagnetic metal ribbon, a magnetic marker was fabricated as in Example 2 and the result of bias field measurement is shown in Table 3. In addition, sixth and twentieth harmonics were measured and the results are shown in FIGS. 17 and 21, respectively. As one can see from FIG. 17, noise prevented the detection of the sixth harmonic at frequencies less than 100 KHz.

Comparative Example 3

A non-magnetic base carrying a ferromagnetic metal ribbon was prepared as in Comparative Example 2 except that the thickness of the ribbon was increased to 66 μm. The ferromagnetic ribbon was measured for its magnetostatic characteristics and the results are shown in Table 3.

Figure 18:
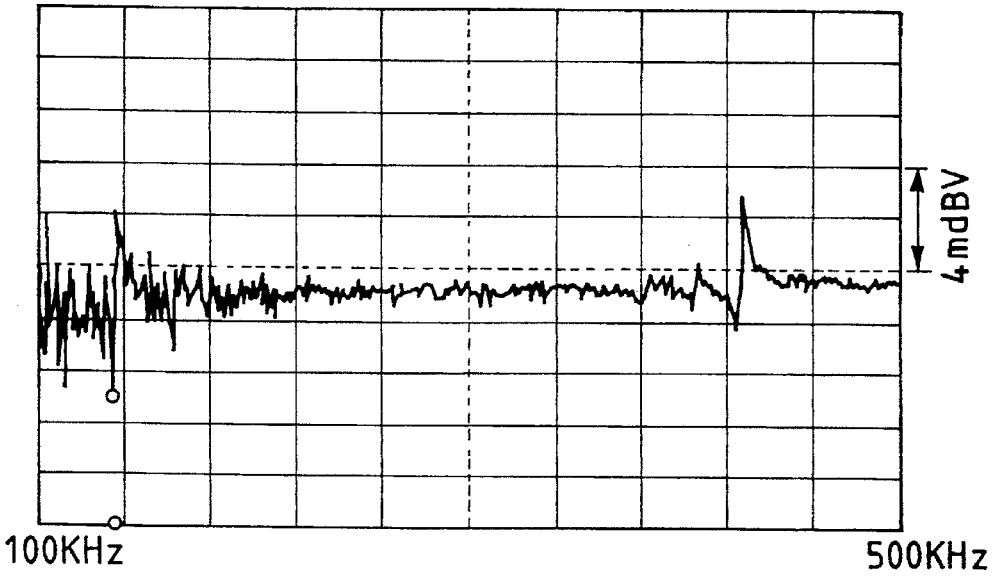
FIG. 18 is a graph showing the result of detecting the signal of a sixth harmonic generated from the magnetic marker fabricated in Comparative Example 3.
Figure 22:
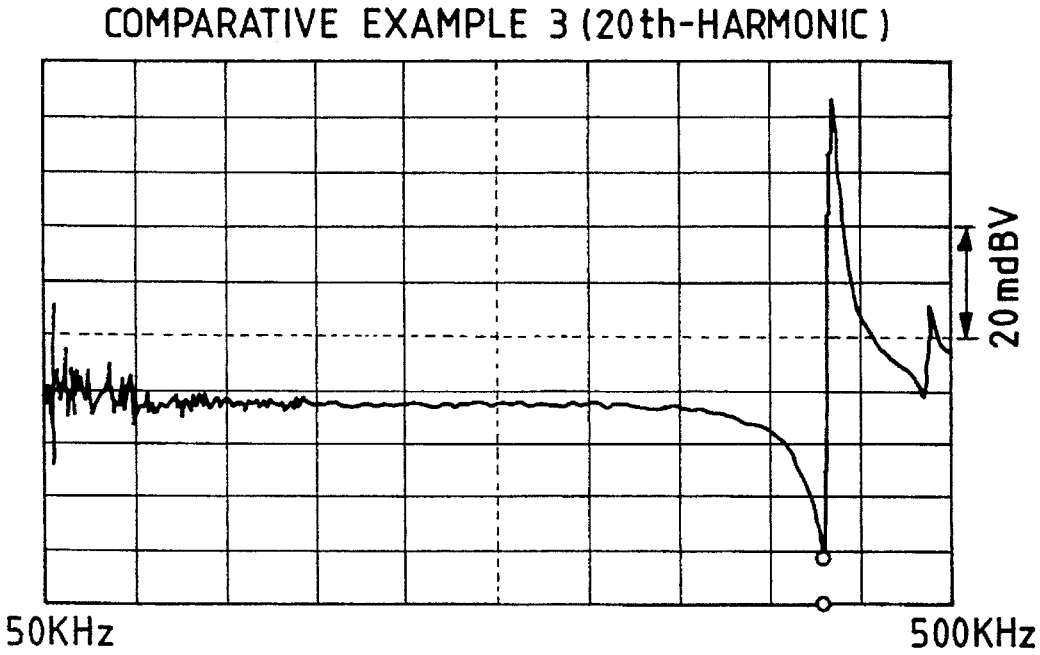
FIG. 22 is a graph showing the result of detecting the signal of a twentieth harmonic generated from the magnetic marker fabricated in Comparative Example 3.

Using the thus prepared non-magnetic base carrying the ferromagnetic metal ribbon, a magnetic marker was fabricated as in Example 2 and the result of bias field measurement is show in Table 3. In addition, sixth and twentieth harmonics were measured and the results are shown in FIGS. 18 and 22, respectively. As one can see from FIG. 18, noise prevented the detection of the sixth harmonic at frequencies less than 100 KHz.

TABLE 3

Magnetostatic characteristics and bias field

| | Thickness of non-magnetic base (μm) | Thickness of magnetic layer (μm) | Coercive force (Oe) | Residual flux density (MX/cm) | Squareness ratio | Bias field (Oe) |
|---|---|---|---|---|---|---|
| Example 2 | | | | | | |
| (1) | 50 | 12.5 | 1584 | 2.6 | 0.81 | 1.5 |
| (2) | 50 | 30 | 1584 | 6.8 | 0.81 | 4.2 |
| (3) | 50 | 40 | 1580 | 7.2 | 0.81 | 5.6 |
| Example 3 | | | | | | |
| (4) | 100 | 30 | 1582 | 6.8 | 0.81 | 2.3 |
| (5) | 100 | 45 | 1585 | 7.0 | 0.81 | 3.5 |
| (6) | 100 | 60 | 1584 | 11.0 | 0.81 | 4.4 |
| Comparative Example 1 | | | | | | |
| (1) | 50 | 12.5 | 693 | 1.45 | 0.83 | 0.8 |
| (2) | 50 | 30 | 688 | 3.3 | 0.83 | 2.0 |
| (3) | 50 | 40 | 695 | 4.0 | 0.83 | 3.1 |
| Comparative Example 2 | 50 | 33 | 45 | 25.2 | 0.44 | 1.8 |
| Comparative Example 3 | 50 | 66 | 45 | 50.4 | 0.44 | 3.5 |

TABLE 4

| AC magnetic characteristics | Example 2 | Example 4 |
|---|---|---|
| Coercive force, Oe | 0.4661 | 0.9625 |
| Saturation flux density, gauss | 6242 | 13050 |
| Residual flux density, gauss | 95.86 | 5780 |
| Squareness ratio | 0.1536 | 0.4430 |
| Hysteresis loss, J/m$^3$ | 28.08 | 217.4 |

TABLE 5

Resonant frequency of 6th harmonic and its signal output

| | Thickness of magnetic layer (μm) | Resonant frequency (KHz) | Signal output (μV) |
|---|---|---|---|
| Example 2 | 12.5 | 134.4 | 260 |
| | 30 | 133.3 | 680 |
| | 40 | 131.0 | 780 |
| Comparative Example 1 | 12.5 | — | — |
| | 30 | 134.3 | 270 |
| | 40 | 133.9 | 430 |
| Example 3 | 30 | 134.1 | 380 |
| | 45 | 133.7 | 520 |
| | 60 | 133.3 | 680 |
| Example 4 | 12.5 | 125.4 | 244 |
| | 30 | 124.3 | 360 |
| | 40 | 123.1 | 792 |

As one can see from FIG. 14, when magnetization was conducted using a rectangular wave, the range of bias field in which the magnetomechanical coupling coefficient of the ferromagnetic and magnetostrictive material assumed the greatest value was narrow irrespective of whether the ferromagnetic and magnetostrictive material was "METGLAS 2826MB" used in Example 2 (4.5 to 6 Oe) or "METGLAS 2605CO" used in Example 4 (5.5 to 7.0 Oe); therefore, the magnetic layer can be magnetized more advantageously with a rectangular wave than with a sinusoidal wave.

One can also see from Tables 3 and 5 that an optimal thickness of the magnetic layer could be obtained by determining the thickness of the non-magnetic base and the preferred bias field strength.

FIGS. 15 and 19 show indirectly the differences in behavior by which a bias field was generated from the magnetic pattern provided in the magnetic marker of the invention by magnetization.

Figure 16:
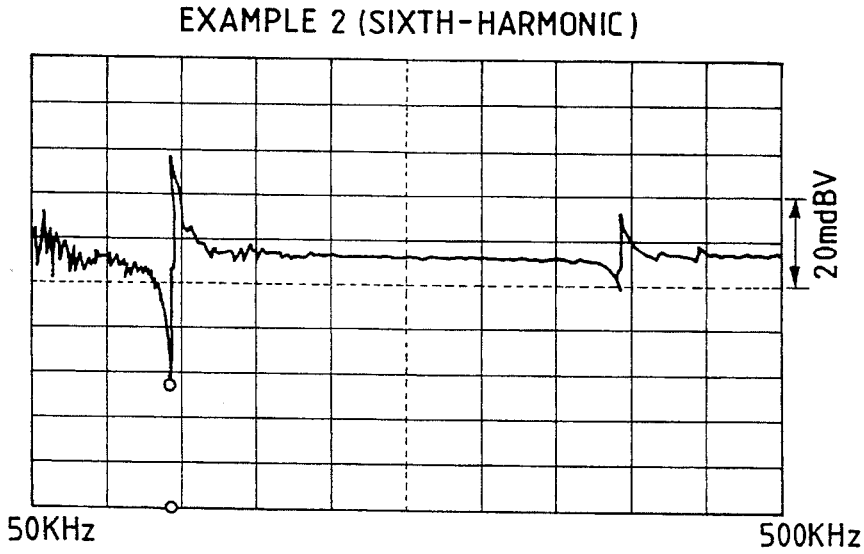
FIG. 16 is a graph showing the result of detecting the signal of a sixth harmonic generated from the magnetic marker fabricated in Example 2.

FIGS. 16 to 18 show the magnitude and sharpness of resonant frequencies as they relate to the top, center and bottom diagrams, respectively, in FIG. 15, and FIGS. 20 to 22 bear the same relationship to the top, center and bottom diagrams in FIG. 19. Obviously, the magnetic layer used as a bias field producing medium in Example 2 was superior to the ferromagnetic metal ribbon used in Comparative Examples 2 and 3. This is due to the high anisotropy and squareness ratio of that magnetic layer (see Table 3).

Figure 23:
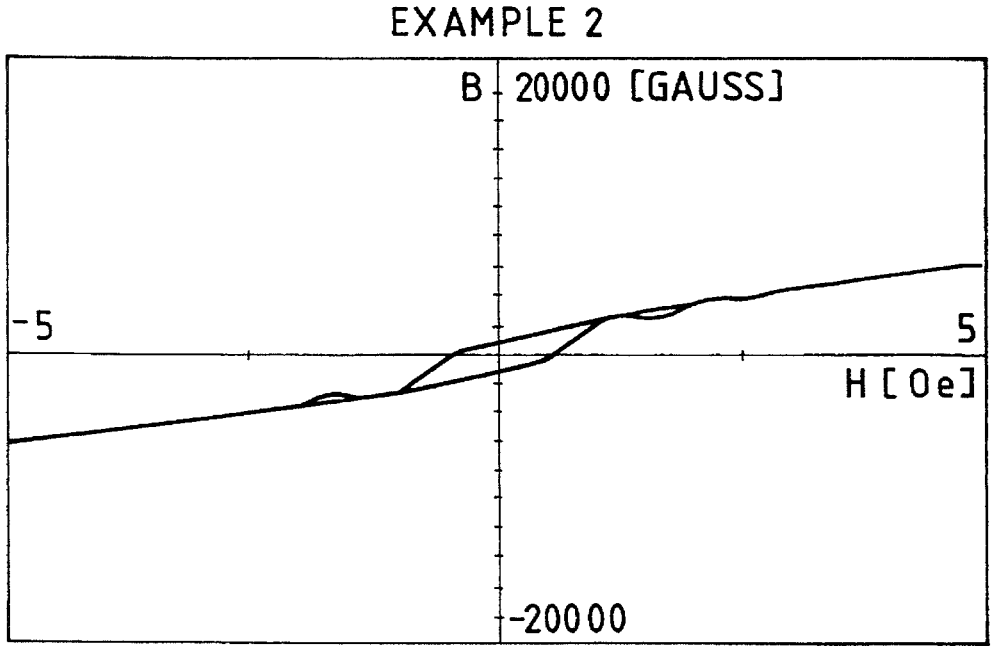
FIG. 23 is a graph showing the hysteresis curve that was obtained when the ductile strip of magnetostrictive metal used in Example 2 was placed in an alternating magnetic field having a frequency of 1 KHz and a maximum field strength of 5 Oe.
Figure 24:
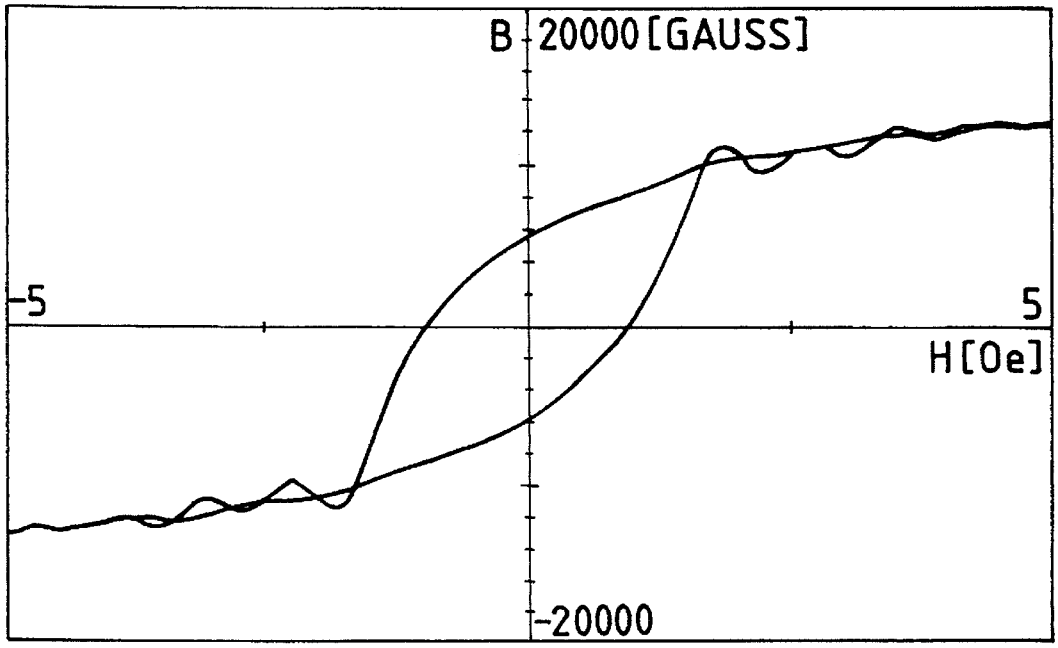
FIG. 24 is a graph showing the hysteresis curve that was obtained when the ductile strip of magnetostrictive metal used in Example 4 was placed in an alternating magnetic field having a frequency of 1KHz and a maximum field strength of 5 Oe.

FIGS. 23 and 24 and Table 4 show the ac magnetic characteristics of the ductile strips of ferromagnetic and magnetostrictive materials suffering different hysteresis losses that were used in Example 2 and 4. The frequency characteristics of the resonant points of the sixth, twelfth and twentieth harmonics generated from those ferromagnetic and magnetostrictive materials suffering different hysteresis losses that were used in Example 2 are shown in FIGS. 25 to 27, respectively; and similar data for the ferromagnetic and magnetostrictive materials used in Example 4 are shown in FIGS. 28 to 30. Comparing these figures, one can see that with the ferromagnetic and magnetostrictive material suffering the greater hysteresis loss (which was used in Example 4), the magnitude and sharpness of resonant frequency decreased with the increasing order of harmonics.

The magnetic marker of the invention for use in identification systems uses a magnetic powder having a higher saturation flux density than the heretofore used ferrite magnetic powder and, hence, the magnetic coating layer that is necessary to produce a bias field can be rendered thinner than in the prior art and this contributes to the possibility of producing more flexible markers. Since a thin magnetic coating suffices, there is no need to build up the magnetic coating to as great a thickness as has been required in the case of the conventional ferrite magnetic powder and, hence, the reject ratio is reduced; this means that if the required performance is the same, more markers can be produced per unit time.

The marker of the invention has the magnetic coating magnetized to have a magnetic pattern and is so adapted that the thus magnetized coating will produce a bias field toward the magnetostrictive metal in the marker. Since the magnetic coating is oriented, the marker of the invention offers the advantages of assuring high resolution of the magnetic pattern which generates higher harmonics and producing higher signal output levels for the resonant frequencies of higher harmonics; combined with the small hysteresis loss of the magnetostrictive metal used, these features contribute to a higher capacity for identification.

As a further advantage, the resonant frequency of the ductile strip of the magnetostrictive metal can be controlled by producing a magnetic pattern with a rectangular wave and this assures compatibility or permits the use of a conventional encoder when the marker is applied to magnetic recording.

The magnetic layers in the working examples of the invention had coercive forces on the order of 1,580 Oe and, hence, the problem associated with unwanted erasure of the magnetic information in the magnetic layer such as by approaching of the metallic buckle of a handbag is small compared to the case of using a metallic ribbon of a hard magnetic material.

Further, unlike the metallic ribbon of a hard magnetic materials, the magnetic layer to be used in the invention is so good in workability that desired materials strength can be assured according to the specific use of the marker, such as whether it is applied to magnetic cards for management of the entrance and exit of visitors, labels on parcels to be delivered and tags for animal identification.

What is claimed is:

1. A magnetic marker for use with an object identification system that comprises an assembly of a dry coating that has a magnetic powder with a saturation flux density of at least 100 emu/g dispersed in a binder and a magnetostrictive metal which, when said coating is magnetized, resonates mechanically at at least one of predetermined frequencies in the range of varying frequencies generated from an applied alternating magnetic field, thereby experiencing changes in flux density and permeability and which, when said coating is not magnetized, does not resonate at said at least one of the predetermined frequencies, thus experiencing no changes in flux density or permeability, said dry coating and said metal being in a superposed relationship in such a way that the latter is capable of mechanical resonance, said marker being so adapted that when said coating is magnetized, said at least one of the predetermined frequencies at which the flux density or permeability will change is generated as a signal in response to said applied alternating magnetic field.

2. A marker according to claim 1 wherein said assembly has the coating and contains the metal in an unfixed manner and wherein said coating is a dry coating that has the magnetic particles dispersed in the binder as they are oriented unidirectionally.

3. A marker according to claim 2 wherein said assembly is such that the direction in which the metal resonates mechanically is the same as the direction of orientation in the coating.

4. A marker according to claim 1 wherein the dry coating has a residual flux (per unit width) of 1 to 25 Mx/cm.

5. A marker according to claim 1 wherein the metal suffers a hysteresis loss of 1 to 50 J/m$^3$ in an alternating magnetic field having a frequency of 1 KHz and a maximum flux density of 5 Oe.

6. A marker according to claim 1 wherein the metal is a magnetostrictive metal having a squareness ratio of no more than 0.3 in an alternating magnetic field having a frequency of 1 KHz and a maximum flux density of 5 Oe.

7. A marker according to claim 1 wherein the dry coating has a thickness of 5 to 100 μm.

8. A marker according to claim 1 wherein the dry coating is formed on a non-magnetic substrate having a thickness of 10 to 250 μm.

9. A magnetic marker for use with an object identification system that comprises an assembly of a dry coating that has been magnetized to have a magnetic pattern according to a bias field and that has a magnetic power with a saturation flux density of at least 100 emu/g dispersed in a binder and a magnetostrictive metal which will resonate mechanically at at least one of predetermined frequencies in the range of varying frequencies generated from an applied alternating magnetic field, thereby experiencing changes in flux density and permeability, said dry coating and said metal being in a superposed relationship in such a way that the latter is capable of mechanical resonance, said marker being so adapted that the predetermined frequency at which the flux density or permeability will change is generated as an identification signal in response to said applied alternating magnetic field according to the magnetic pattern produced in the magnetized coating.

10. A marker according to claim 9, further comprising a single assembly of the coating and the metal and which is so adapted as to generate at least two predetermined frequencies as identification signals.

11. A marker according to claim 10 wherein said assembly has the coating and contains the metal in an unfixed manner and wherein said coating is a dry coating that has the magnetic particles dispersed in the binder as they are oriented unidirectionally.

12. A marker according to claim 11 wherein said assembly is such that the direction in which the metal resonates mechanically is the same as the direction of orientation in the coating.

13. A marker according to claim 12 wherein the magnetic pattern produced in the coating by magnetization consists of a plurality of magnetized elements such that the N (or S) pole of one of two adjacent elements is at least in a face-to-face relationship with the N (or S) pole of the other element and that both ends of said magnetic pattern coincide with both ends of the metal.

14. A marker according to claim 9 wherein the magnetic pattern to be produced by magnetization consists of a sinusoidal wave or an amplitude-composed sinusoidal wave.

15. A marker according to claim 9 wherein said magnetic pattern is produced by magnetization by a rectangular wave pattern or a composite rectangular wave pattern that is produced by composition of rectangular wave patterns of different frequencies.

16. A marker according to claim 9 wherein the dry coating has a residual flux (per unit width) of 1 to 25 Mx/cm.

17. A marker according to claim 9 wherein the metal suffers a hysteresis loss of 1 to 50 $J/m^3$ in an alternating magnetic field having a frequency of 1 KHz and a maximum flux density of 5 Oe.

18. A marker according to claim 9 wherein the metal is a magnetostrictive metal having a squareness ratio of no more than 0.3 in an alternating magnetic field having a frequency of 1 KHz and a maximum flux density of 5 Oe.

19. A marker according to claim 9 wherein the dry coating is formed on a non-magnetic base having a thickness of 10 to 250 μm.

20. An identification system that comprises:

a detection area for object identification;

an external alternating magnetic field producing means that is provided within said area and which performs sweeping through a range of frequencies to generate varying frequencies;

a magnetic marker for use in the object identification system as attached to an object that needs to be identified and that is predestined to pass through said area, said marker comprising an assembly of a coating that has been magnetized to have a magnetic pattern according to a bias field and that has a magnetic powder with a saturation flux density of at least 100 emu/g dispersed in a binder and a magnetostrictive metal which will resonate mechanically at least one of predetermined frequencies within the range of frequencies that are generated from the means within the area in such a way as to experience changes in flux density and permeability, said dry coating and said metal being in a superposed relationship so that the latter is capable of mechanical resonance, said marker being so adapted that the predetermined frequency at which the flux density or permeability will change is generated as an identification signal within said area according to the magnetic pattern produced in the magnetized coating; and means for detecting the resonance of said marker at least one of the predetermined frequencies which is generated from the means within the area and recognizing said resonance as an identification signal; said system thus responding to the presence of the marker within the detection area.

* * * * *